US012286738B2

(12) United States Patent
Yao et al.

(10) Patent No.: US 12,286,738 B2
(45) Date of Patent: Apr. 29, 2025

(54) ARTICLE PROVIDED WITH REFLECTIVE YARN AS A SAFETY MECHANISM

(71) Applicant: LIGHT TEXTILE INC., Taichung (TW)

(72) Inventors: Ming-Hsien Yao, Taichung (TW); Shun-Tai Yao, Taichung (TW)

(73) Assignee: LIGHT TEXTILE INC., Taichung (TW)

( * ) Notice: Subject to any disclaimer, the term of this patent is extended or adjusted under 35 U.S.C. 154(b) by 170 days.

(21) Appl. No.: 18/337,746

(22) Filed: Jun. 20, 2023

(65) Prior Publication Data

US 2023/0399782 A1 Dec. 14, 2023

Related U.S. Application Data

(63) Continuation-in-part of application No. 17/836,640, filed on Jun. 9, 2022, now Pat. No. 12,195,901.

(51) Int. Cl.
*D05B 93/00* (2006.01)

(52) U.S. Cl.
CPC ..... *D05B 93/00* (2013.01); *D10B 2401/20* (2013.01); *D10B 2403/0114* (2013.01)

(58) Field of Classification Search
CPC ..... D05B 93/00; D05B 1/08; D10B 2401/20; D10B 2403/0114; D10B 2403/00; D10B 2403/011
See application file for complete search history.

(56) References Cited

U.S. PATENT DOCUMENTS

| | | | | |
|---|---|---|---|---|
| 2,937,668 | A * | 5/1960 | Carey, Jr. | D06Q 1/04 57/251 |
| 4,517,685 | A * | 5/1985 | Lesley | A41D 31/32 359/518 |
| 2007/0119358 | A1 | 5/2007 | Okita et al. | |
| 2020/0229516 | A1* | 7/2020 | Curran | A41D 1/06 |
| 2020/0257024 | A1* | 8/2020 | Abrams | D06N 3/0068 |
| 2022/0178691 | A1* | 6/2022 | Prince | G01C 15/06 |

FOREIGN PATENT DOCUMENTS

| | | | | |
|---|---|---|---|---|
| EP | 0791306 | A1 * | 8/1997 | |
| EP | 3252195 | A1 | 12/2017 | |
| EP | 3875648 | A1 | 9/2021 | |
| JP | 2003169982 | A | 6/2003 | |
| KR | 1020180103641 | A | 9/2018 | |
| TW | 201002896 | A | 1/2010 | |
| WO | WO-2010126189 | A1 * | 11/2010 | D02G 3/36 |
| WO | WO-2018131772 | A2 * | 7/2018 | A44B 19/00 |

* cited by examiner

*Primary Examiner* — Ismael Izaguirre
(74) *Attorney, Agent, or Firm* — Guice Patents PLLC

(57) ABSTRACT

An article provided with reflective yarn has a sheet-shaped object, one or more than one upper threads, at least one lower thread, and one or more than one reflective yarns. The one or multiple upper threads sewn on a font side of the sheet-shaped object, the one or multiple reflective yarns with glass beads are disposed on the front side of the sheet-shaped object without penetrating the object, the reflective yarns are pressed and held on the front side of the object by the upper threads. On the front side of the sheet-shaped object, the one or multiple reflective yarns form a plurality of reflective lines, and the reflective lines are kept apart with intervals.

12 Claims, 18 Drawing Sheets

ARTICLE PROVIDED WITH REFLECTIVE YARN AS A SAFETY MECHANISM

This application is a Continuation-In-Part currently pending application U.S. Ser. No. 17/836,640, entitled "THREAD BODY SEWING STRUCTURE" and filed on Jun. 9, 2022, and which is incorporated herein by reference in its entirety.

BACKGROUND OF THE INVENTION

Field of Invention

The invention relates to an article with reflective function, in particular an article that provides a safety mechanism with reflective yarn.

Related Art

Clothes are necessities for people. Clothes can be made with reflective (light-reflective) function, such as sticking reflective strips or reflective sheets on clothes to reflect light is capable of improving the safety of people's activities at night and reducing the probability of accidents.

In terms of providing reflective effect, in addition to sticking reflective strips or reflective sheets mentioned above, another method is to sew reflective yarns on clothes, the surface of the reflective yarn is adhered with numerous tiny glass beads, and the reflective yarn can provide reflective effect to the clothes through the glass beads.

Because the reflective yarn is embedded with the glass beads, it is easy to break, so the bare reflective yarn cannot be sewn by a sewing machine directly. The reflective yarn must be twisted with other yarns into two or three strands of yarn before the reflective yarn can be sewn on clothes. However, the yarn diameter of the above-mentioned twisted multi-strand yarn is too thick and not fine, which increases the resistance of sewing.

Furthermore, although the reflective yarn can be sewn on clothes by twisting it with other yarns into multiple strands, the glass beads on the surface of the reflective yarn will fall off and damage the reflective yarn due to rubbing against the fabric during the process of passing through the fabric, and the glass beads on the surface of the reflective yarn are imperfect, which affects the reflective performance of the reflective yarn and causes defects in reflective clothing. The glass beads of the reflective yarn falling off during the sewing process, causing the safety function of the reflective yarn to be incomplete.

If the reflective yarn is sewn on the clothes, the reflective yarn penetrates in the clothes from a front side of the fabric and exits from a back side of the fabric, then the reflective yarn is refolded and penetrated from the back side of the fabric and passed out from the front side of the fabric, and then the reflective yarn is refolded again and penetrated in from the front of the fabric. After sewing, the reflective yarn will form many bends on the surface of the fabric, and the bends of the reflective yarn will protrude more from the surface of the fabric, which will have a stinging sensation and uncomfortable.

Glass beads have a higher density and weight, which makes the fabric sewn with glass beads reflective yarn heavy. The cost of glass bead reflective yarn is much higher than that of ordinary yarn, so the clothes sewn with reflective yarn are not only heavier, but also the manufacturing cost is higher.

Moreover, when the reflective yarn is combined with the fabric by sewing into the fabric, half of the reflective yarn is inside the fabric and the other half is exposed on the surface of the fabric. Therefore, the consumption of reflective yarn is large and the cost is high, and the fabric and clothes are heavy.

SUMMARY OF THE INVENTION

The object of the invention is to provide an article with a safety mechanism by means of reflective yarn, and the reflective yarn forms a plurality of reflective lines on the article, so that the article has a safety function through the reflective lines, and the reflective yarn does not pass through the article, and the safety function will not be damaged or weakened.

Another object of the invention is to provide an article that provides a safety mechanism with reflective yarn, which can make the article have safety function and light weight, and the manufacturing cost is reduced.

Another object of the invention is to provide an article that provides a safety mechanism with reflective yarn, which can reduce the consumption of reflective yarn.

Another purpose of the invention is to provide an article that provides a safety mechanism with reflective yarn, the reflective lines on the article will not cause a stinging sensation and has a comfortable touch.

The article provided with reflective yarn provided by the invention comprises:

- a sheet-shaped object with a front side and a bottom side located on a side opposite to the front side;
- one or more than one upper threads sewn on the sheet-shaped object along a sewing direction and located on the front side of the sheet-shaped object;
- at least one lower thread disposed on the bottom side of the object, the at least one lower thread and said one or more than one upper threads being connected with each other, and
- one or more than one reflective yarns with glass beads, said one or more than one reflective yarns being disposed on the front side of the sheet-shaped object without penetrating or passing through the object, said reflective yarns being pressed and held on the front side of the object by said upper threads;
- on the front side of the sheet-shaped object, said one or more than one reflective yarns form a plurality of reflective lines, and said reflective lines are kept apart with intervals.

Accordingly, the reflective yarn 40 does not pass through the article, the glass beads 42 of the reflective yarn will not fall off, the glass beads on a surface of the reflective yarn can be maintained intact without detracting from a reflective function of the reflective yarn.

Bare reflective yarn can be directly used in the invention, the reflective yarn does not need to be twisted with other yarns or threads into a yarn with multiple strands.

The reflective yarn 40 is flat on the surface of the fabric, and does not pass through the fabric, so the reflective yarn 40 will not form any bends on the surface of the fabric, a comfortable touch is achieved.

The reflective lines 50 of the invention are spaced apart, arranged at intervals, and have a lightweight design, which can reduce the weight of clothes and material costs and manufacturing costs, while maintain the reflective function.

The reflective yarn 40 of the invention is directly exposed on the surface of the fabric and does not penetrate into the fabric. No part of the reflective yarn is inside the fabric, the amount of the reflective yarn used in the invention is greatly reduced.

Preferably, said one or more than one upper threads form a plurality of seam sections on the front side of the sheet-shaped object along the sewing direction of said one or more than one upper threads, and said one or more than one reflective yarns are pressed by the seam sections of said one or more than one upper threads.

Preferably, each of said reflective yarns is held by each of said upper threads, and each of said reflective yarns passes each of said upper threads from two sides of the upper thread alternately.

Preferably, each of said reflective yarns is held by each of said upper threads, and each of said reflective yarns passes the seam sections of each of said upper threads in sequence.

Preferably, each of the said reflective yarns is held by each of said upper threads, and each of said reflective yarns passes the non-adjacent seam sections of each of said upper threads and is held by the non-adjacent seam sections.

Preferably, wherein every two adjacent reflective lines of said reflective lines are lines spaced with an interval Preferably, said reflective lines are straight lines, arc lines or wavy lines.

Preferably, a plurality of said reflective lines are of short length, and the short reflective lines are arranged at intervals along a second direction to form a reflective line strip.

Preferably, the longitudinal direction of the short reflective lines is in a first direction, and the length of the short reflective lines in the first direction is the width of the reflective line strip.

Preferably, said reflective lines form at least one patterns on the front side of the sheet-shaped object.

Preferably, the article is a clothing or a bag, made of the sheet-like object; said reflective lines are located on an outer surface of the clothing or the bag.

BRIEF DESCRIPTION OF THE DRAWINGS

The objects, features, and achieved efficacies of the invention can be understood from the description and drawings of the following preferred embodiments, in which:

FIG. 11A is a partial enlarged view of FIG. 11.

DETAILED DESCRIPTION OF THE INVENTION

Figure 1:
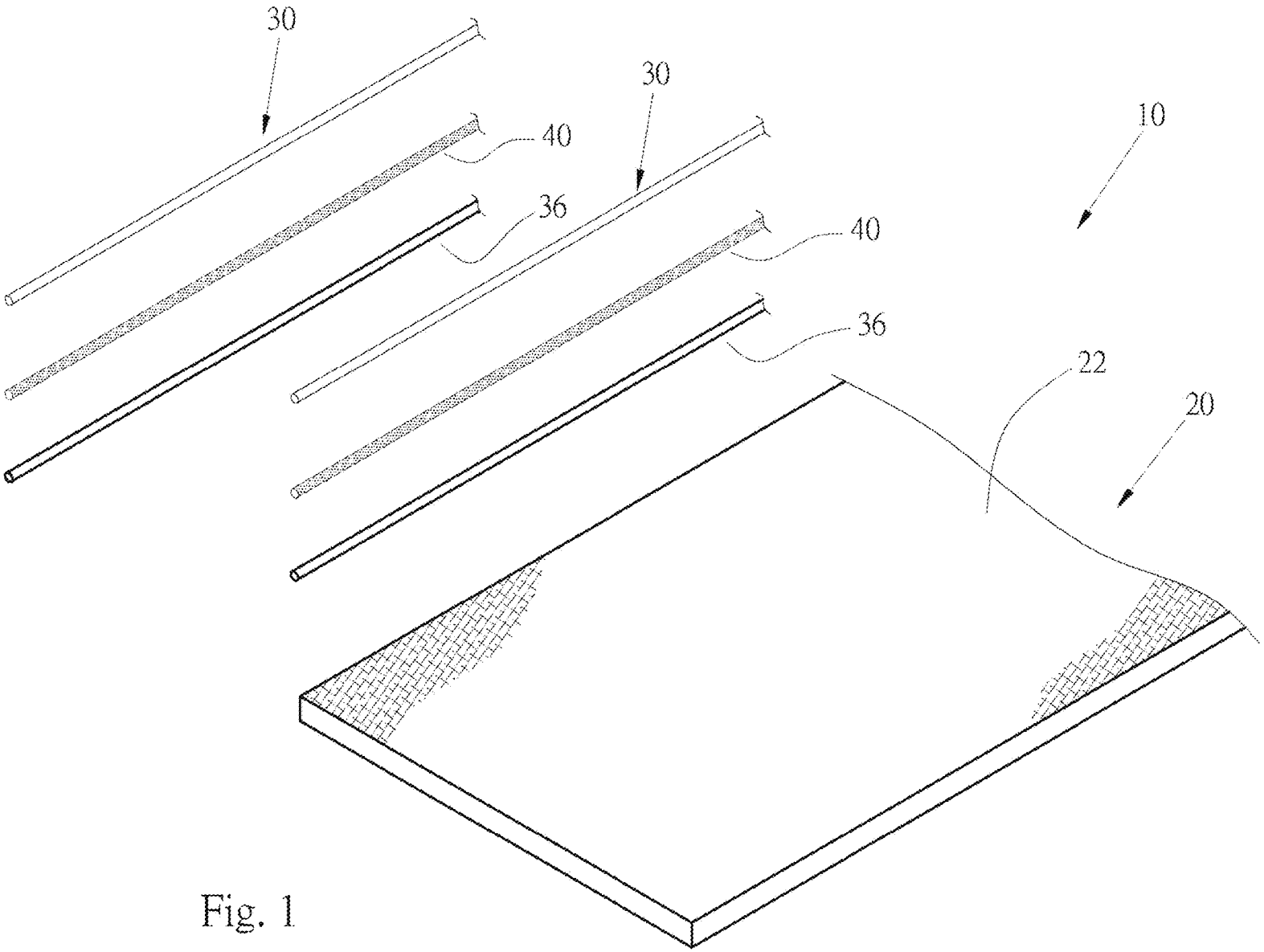
FIG. 1 is a perspective exploded view of an article with reflective yarns that provides a safety mechanism according to a first preferred embodiment of the invention.
Figure 5:
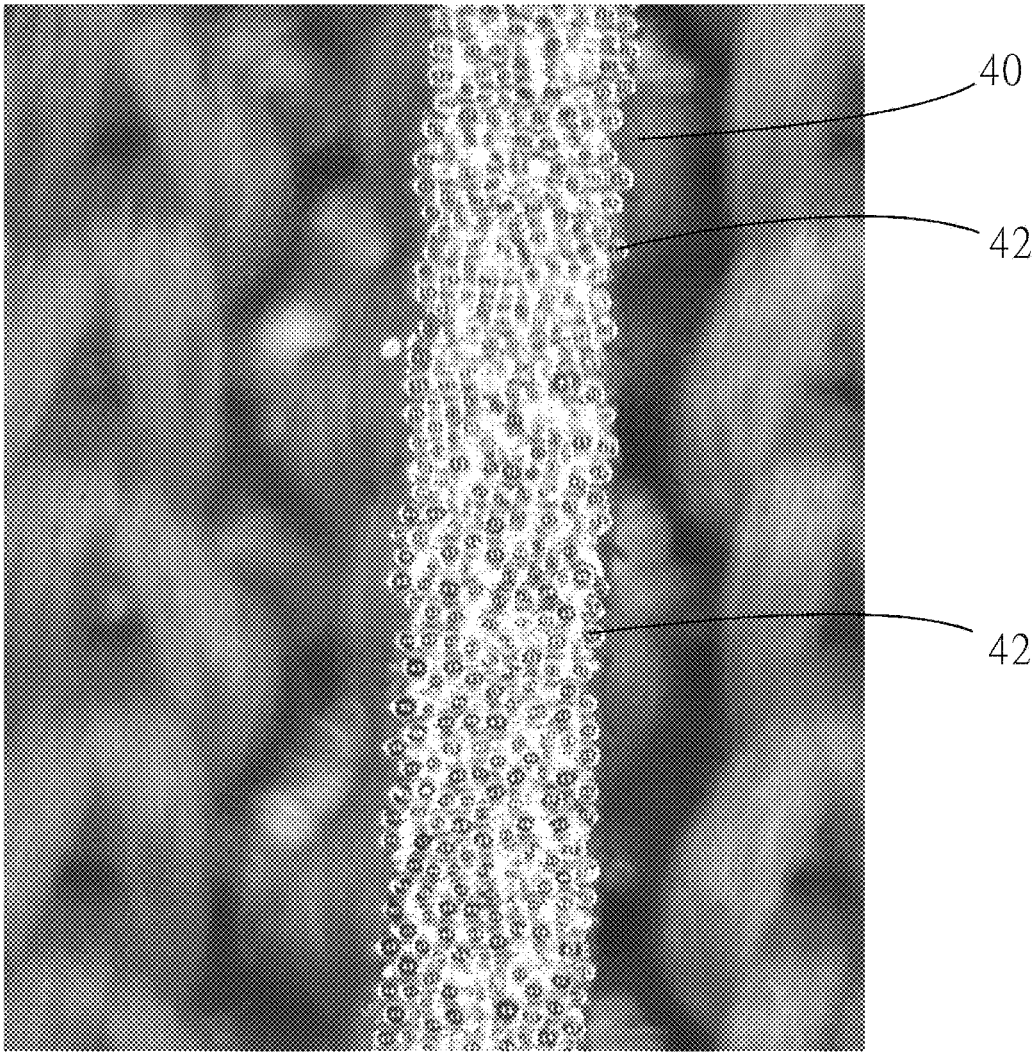
FIG. 5 is a photomicrograph of a reflective yarn of invention.

Please refer to FIG. 1, which shows components comprised in an article provided with reflective yarn as a safety mechanism of a first preferred embodiment of the invention, comprising: a sheet-shaped object 20, two or more than two upper threads 30, two or more than two lower threads 36, and two or more than two reflective (light-reflective) yarns 40. The reflective yarn 40 described in the specification and the claims of the invention refers to a thread, yarn or fiber with reflective function. The reflective yarn 40 of the invention is a thread, yarn or fiber with a plurality of micro glass beads 42 on the surface, as shown in FIG. 5, the reflective yarn 40 reflects light through the glass beads 42.

The sheet-shaped object 20 is a material that can be sewn with a sewing thread, such as fabric (cloth), leather (artificial or natural leather), plastic, paper, etc. The sheet-shaped object 20 in this embodiment is a fabric. Please refer to FIGS. 2 to 4, the sheet-shaped object 20 has a front side 22 and a bottom side 24 on a side opposite to the front side 22. The article 10 is made of the sheet-like object 20, which can be clothing for people or bags, the clothing may be sports shoes shown in FIG. 8 or various shoes, or various kinds of clothing such as clothes, pants, trousers or socks as shown in FIG. 9, or gloves, hats or backpacks and the like. The sheet-shaped object 20 in this embodiment is exemplified as a fabric, which can be made into clothing, pant, shoe, sock, glove, hat, tie, scarf, handkerchief, silk scarf, neckerchief, or the like.

Figure 2:
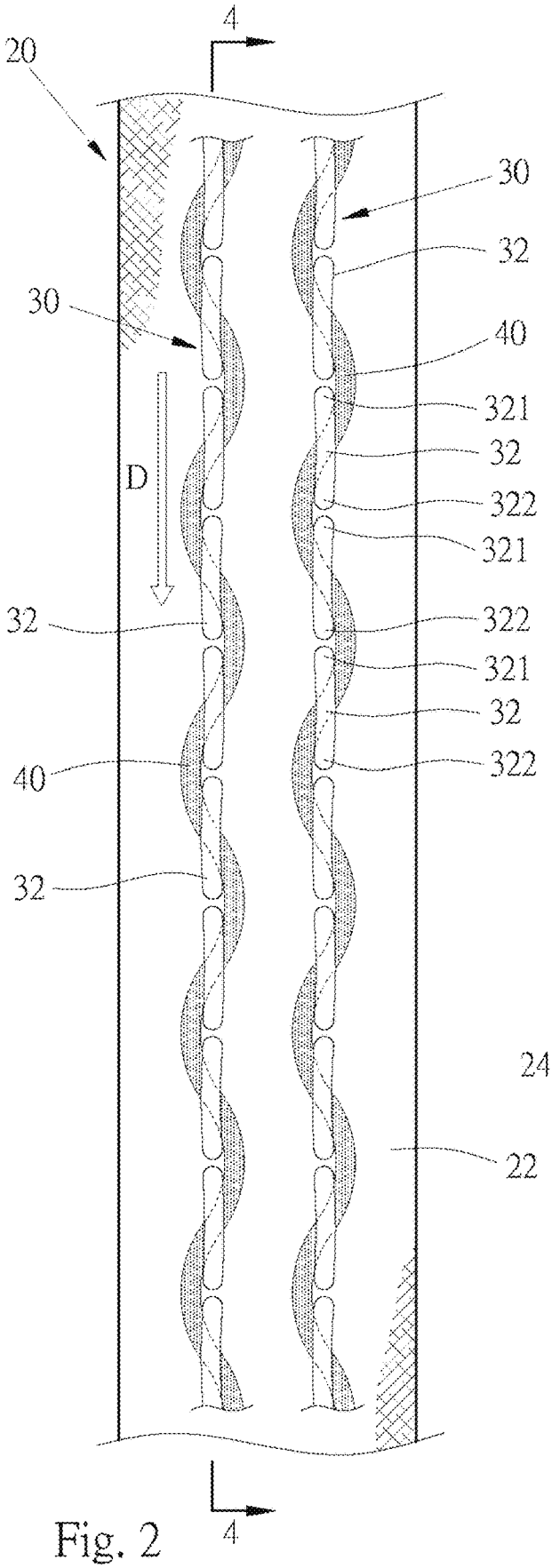
FIG. 2 is a top view of the article of FIG. 1, where the upper threads, the lower threads and the reflective yarns are disposed on the article.
Figure 3:
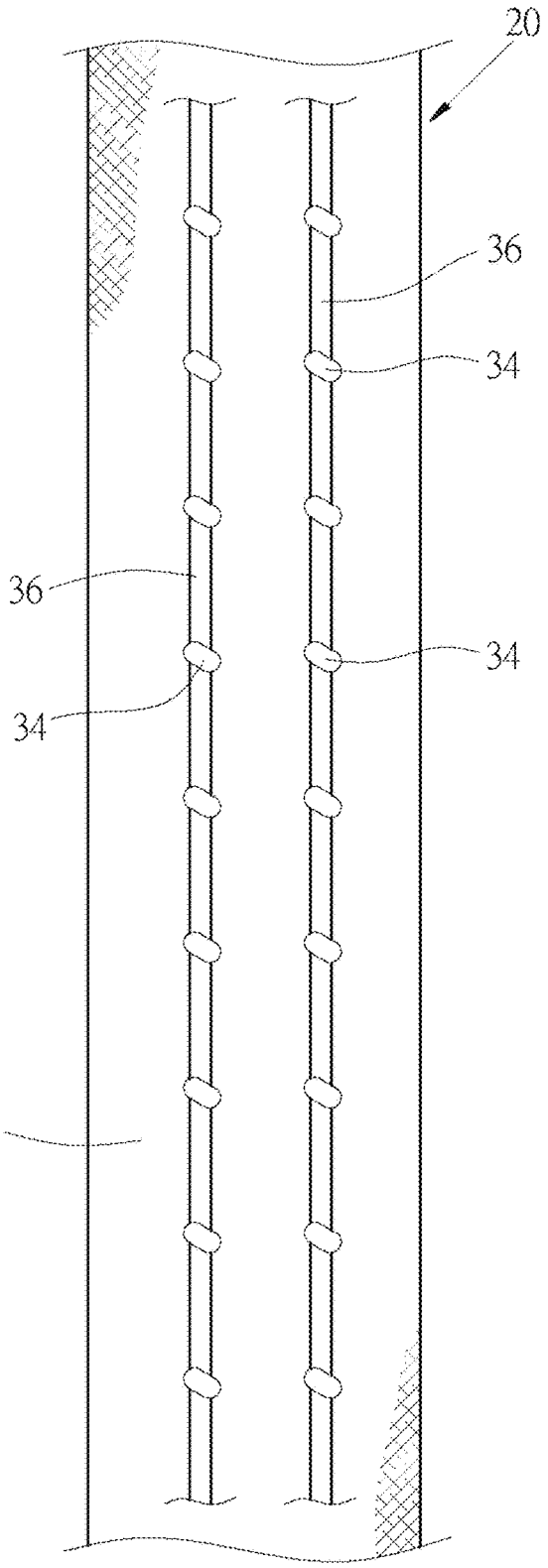
FIG. 3 is a bottom view of FIG. 2.

Please refer to FIG. 2 to FIG. 3, the upper threads 30 and lower threads 36 are various sewing threads that can be used for sewing, which can be made of artificial or natural materials, and are sewn on the sheet-shaped object 20 in a sewing manner, the upper threads 30 are sewed on the front side 22 of the object 20, and the lower threads 36 are disposed on the bottom side 24 of the object 20.

The reflective yarn 40 is disposed on the front side 22 of the sheet-shaped object 20, and is pressed and held on the front side 22 of the sheet-shaped object by the upper thread 30 without penetrating into or passing through the sheet-shaped object 20.

Figure 4:
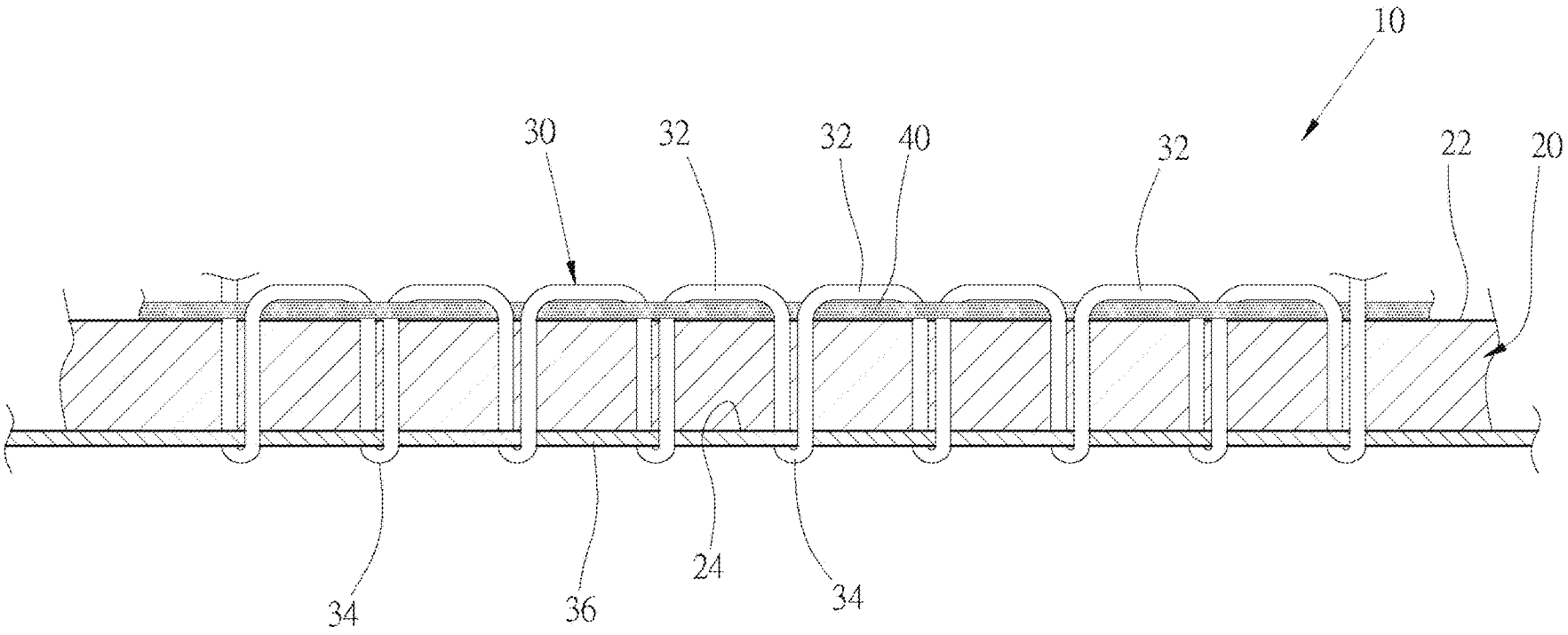
FIG. 4 is a cross-sectional view taken along section line 4-4 of FIG. 2.

Please refer to FIGS. 2 to 4, each reflective yarn 40 is held on the front side 22 of the sheet object 20 by an upper thread 30 and a lower thread 36. In the embodiment, the upper thread 30 and the lower thread 36 are sewn on the object 20 in a sewing manner, and the reflective yarn 40 is pressed and held by the upper thread 30 during a sewing process. A sewing machine is used to sew the upper thread 30, the lower thread 36 and the reflective yarn 40 on the object 20, and a structure for laying the reflective yarn 40 is a mechanism additionally installed on the sewing machine, the mechanism is not a subject matter of the invention and thus will not be described herein.

Please refer to FIGS. 2 to 4, the upper thread 30 is sewn on the sheet object 20 along a sewing direction D and forms seam sections 32 on the font side 22 of the object 20, the seam sections 32 are arranged along the sewing direction D of the upper thread 30. Usually, the seam sections 32 are of a same length and arranged at equal intervals. Two ends 321, 322 of each of the seam sections 32 of an upper thread 30 are arranged along the sewing direction D of the upper thread 30, the first end 321 of each of seam sections 32 is adjacent to the second end 322 of an adjacent seam section 32. The upper thread 30 forms several cross portions 34 on the bottom side 24 of the object 20, and the cross portions 34 cross the lower thread 36, so that the lower thread 36 and the upper thread 30 are hooked to each other on the bottom side 24 of the object 20. The sewing direction D shown in the figures is in a straight direction as an example, the sewing direction D of the upper thread 30 is not limited to straight direction, and can be various sewing directions such as arc direction, polygonal direction, zigzag direction, or wave direction.

The reflective yarn 40 is laid along the sewing direction D of the upper thread 30, that is, a laying direction of the reflective yarn 40 is disposed along the sewing direction of the upper thread 30, the reflective yarn 40 is pressed by the seam sections 32 of the upper thread 30, and thus is held on the front side 22 of the object 20. During a sewing process, in addition to continuous release of the upper and lower threads 30, 36, the reflective yarn 40 is also continuously released, and the reflective yarn 40 is threaded under the seam sections 32 in sequence and is pressed by the seam sections 32.

Figures 6, 7:
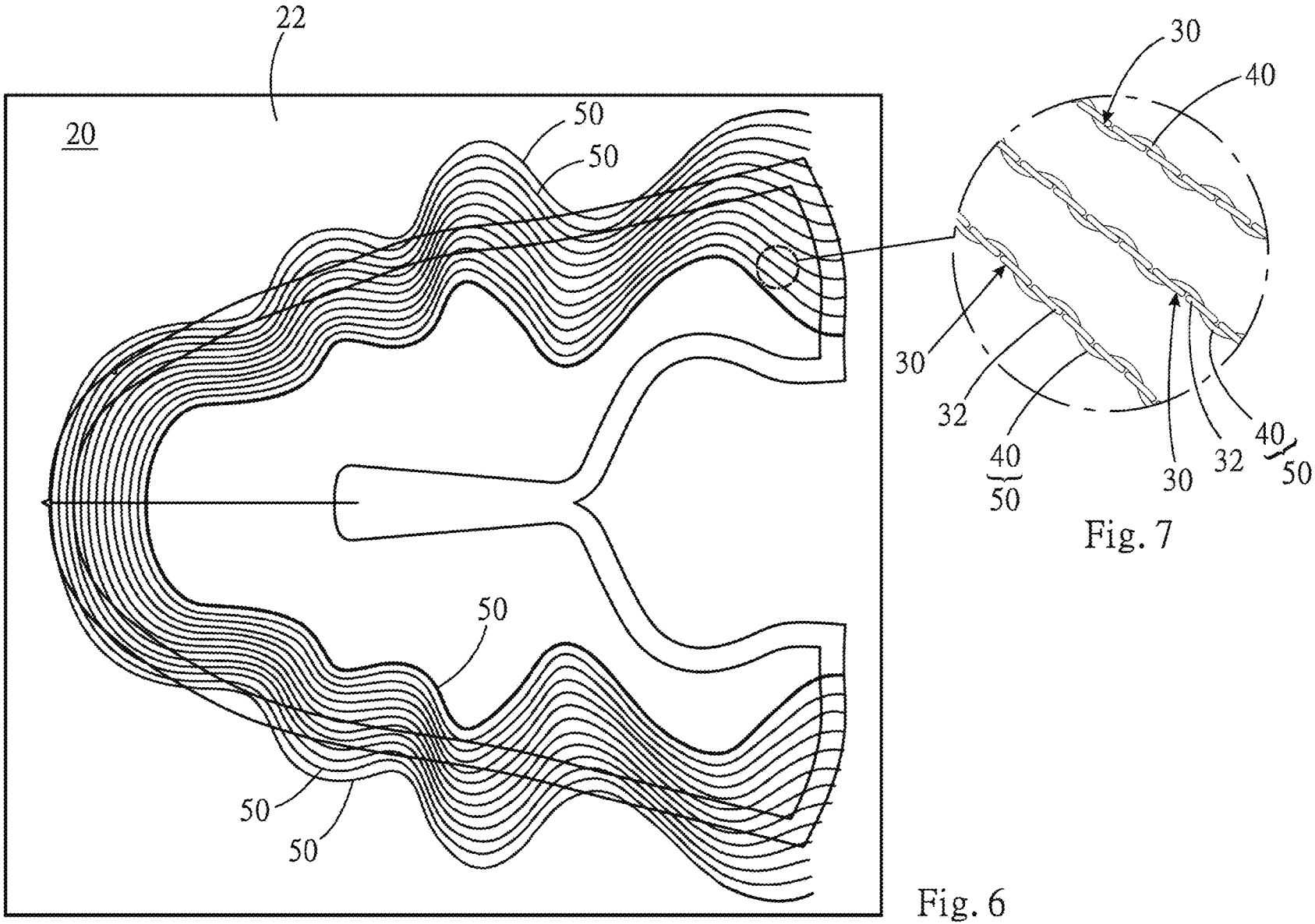
FIG. 6 is a front view of the sewing thread and reflective yarn of the invention arranged on a vamp, and reflective lines are formed on the vamp.
FIG. 7 is a partial enlarged view of FIG. 6.

FIG. 6 shows several upper threads 30 and several lower threads (not shown) of the first preferred embodiment of the invention to hold several reflective yarns 40 on the front side 22 of the sheet-like object 20, so that the reflective yarns 40 form several reflective lines 50 on the front side 22 of the object 20, that is, as shown in FIG. 7, the reflective lines 50 are formed by the reflective yarn 40 held by upper threads 30. The reflective lines 50 shown in FIG. 6 are wavy lines set in a wavy pattern, every two adjacent reflective lines 50 are kept apart with an interval. These reflective lines 50 are all wavy lines/patterns of the same shape, arranged regularly.

Figure 8:
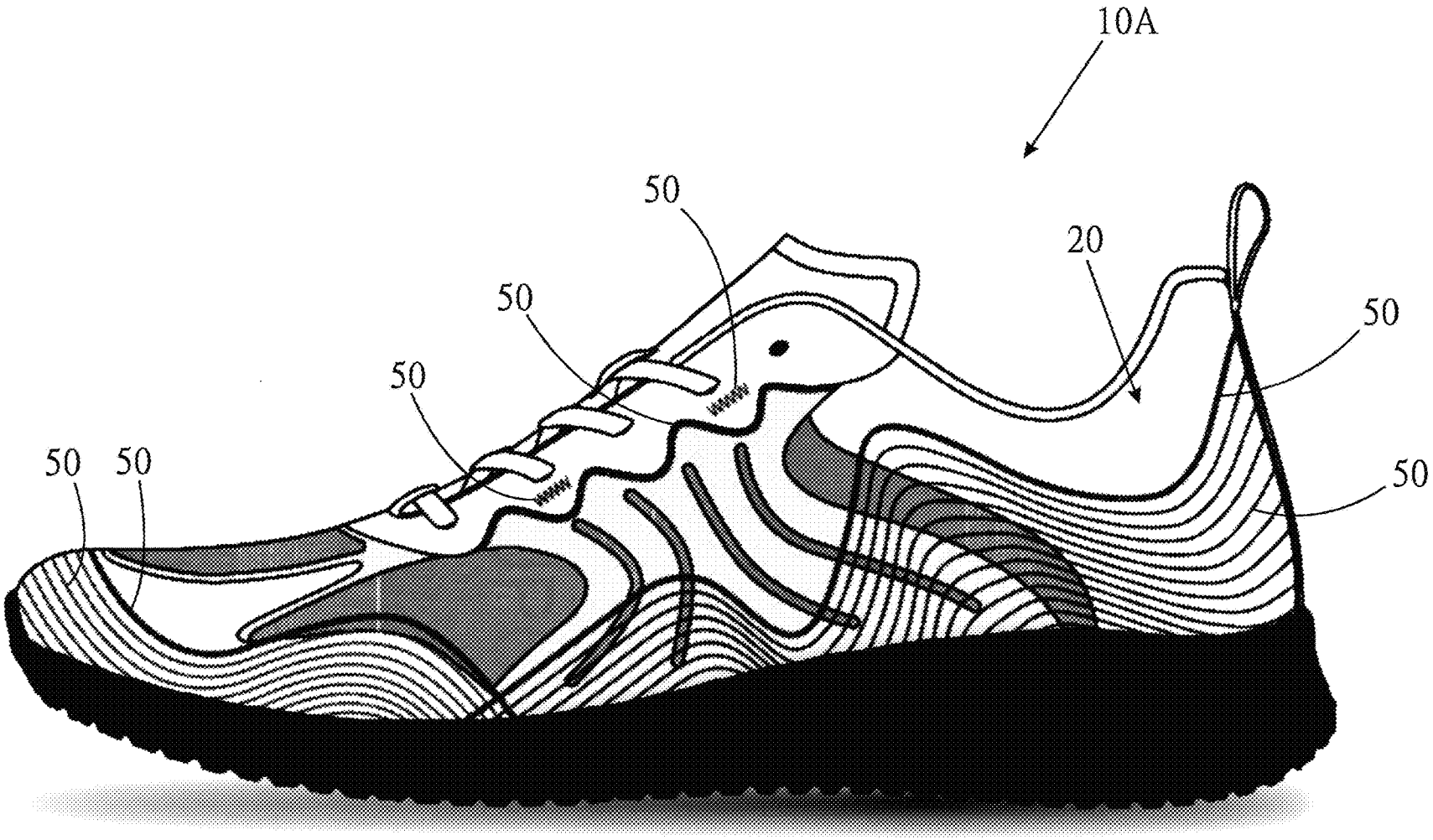
FIG. 8 is a side view of a sports shoe, the vamp of which is provided with reflective lines formed by the sewing threads and reflective yarns in FIG. 2.
Figure 9:
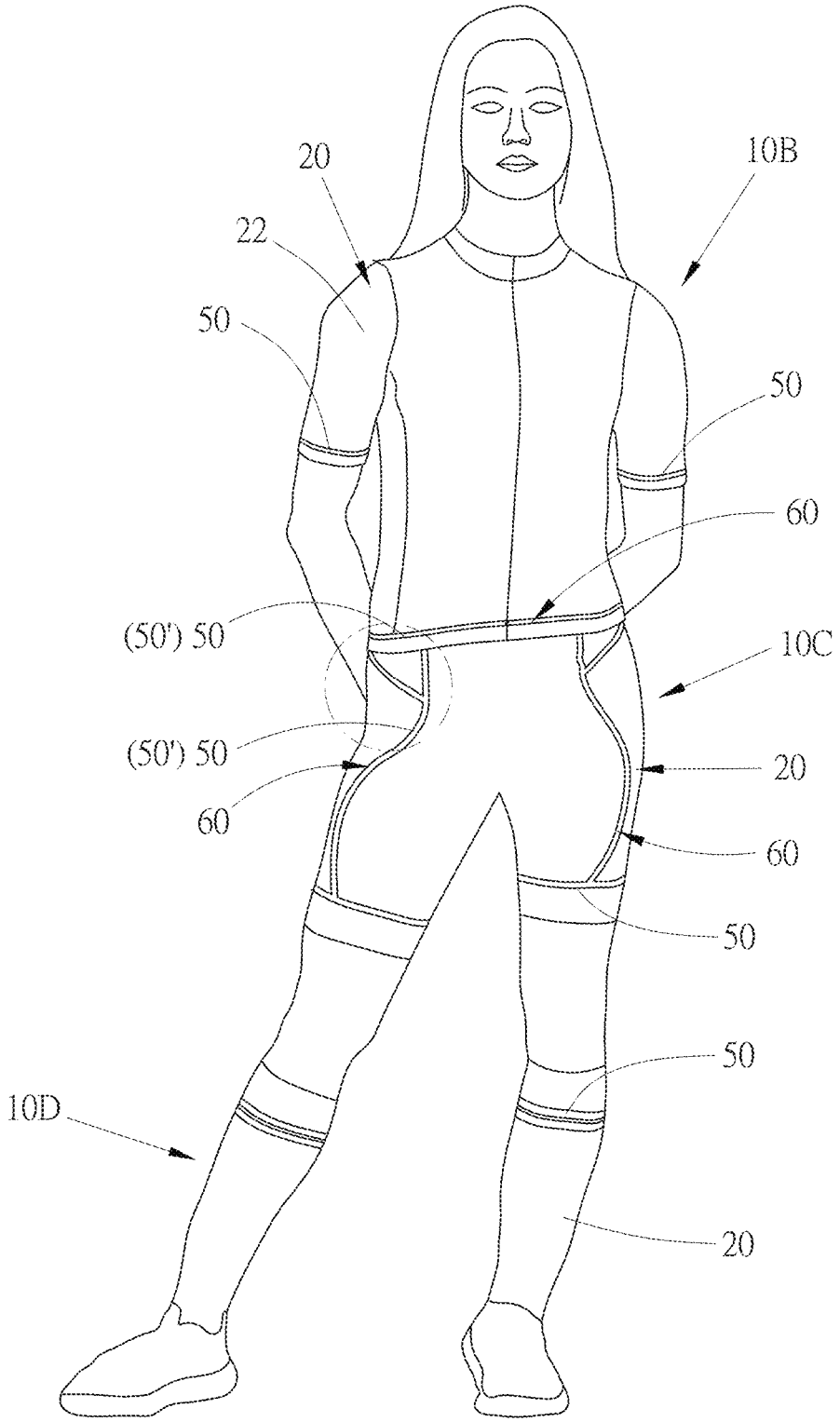
FIGS. 9 and 10 show a front view and a back view of a model wearing clothing, the surface of which is provided with reflective lines.

The sheet-shaped object in FIG. 6 is cut into a vamp of a sports shoe, and made into the sports shoe 10A in FIG. 8, the front side 22 of the sheet-shaped object becomes an outer surface of the vamp 20. The outer surface of the vamp 20 of the sports shoe 10A is provided with a plurality of reflective lines 50 in the form of waves and zigzags, which can reflect light and provide safety.

Figure 10:
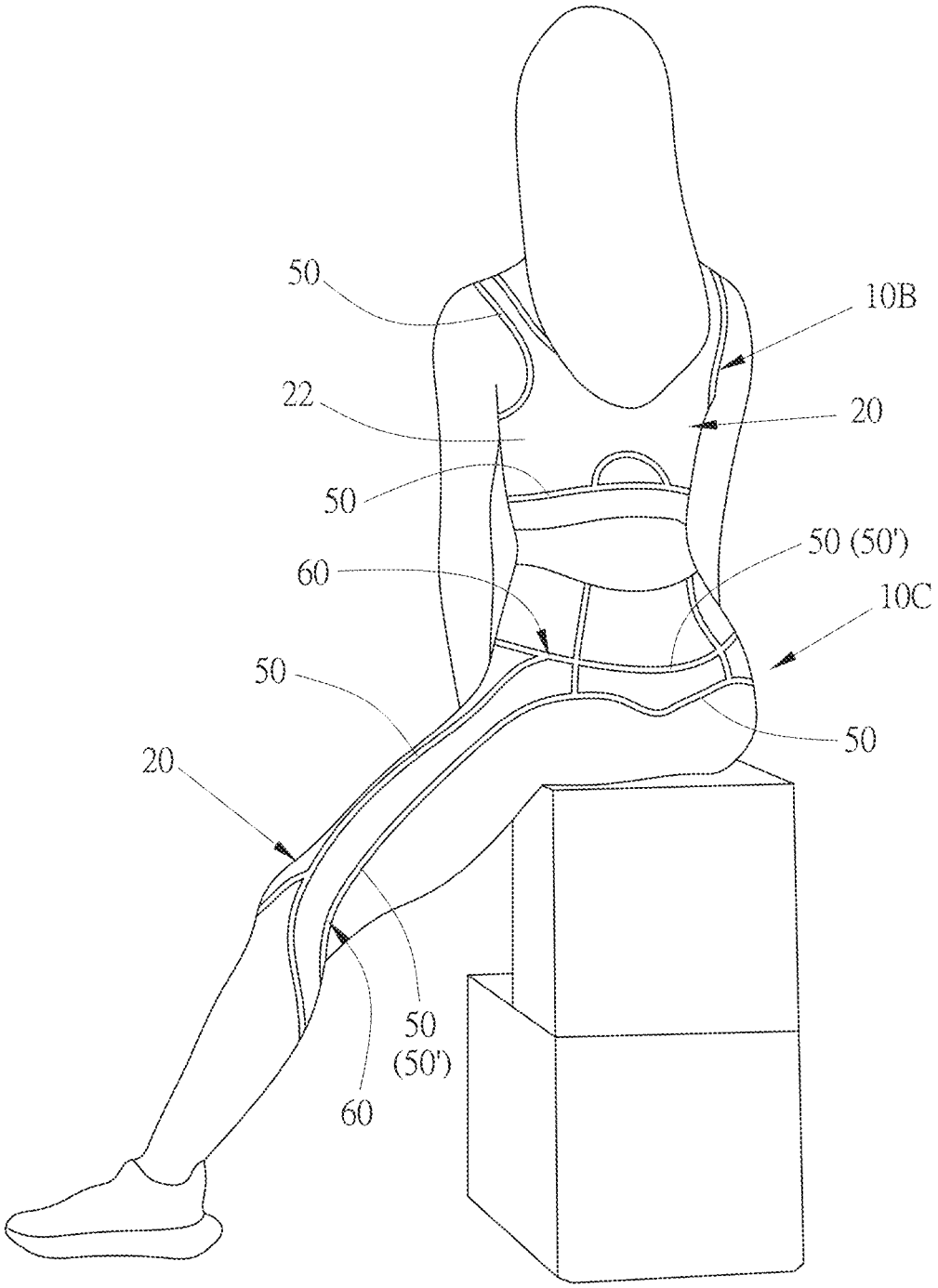

FIGS. 9 and 10 show that the sheet-like object (fabric) 20 is made into an article of clothing such as sportswear 10B, sweatpants 10C, and socks 10D, and the front side of the sheet-like object 20 becomes the outer surface of the clothing. The outer surfaces of the sportswear, sweatpants and socks have reflective lines 50 to provide a safety feature. These reflective lines 50 can be arranged on the conspicuous places of the sportswear, or on the cuffs and necklines of the sportswear 10B, or the sewing parts of the sportswear, such as the hem of the sportswear, or the openings of the socks.

Figure 11:
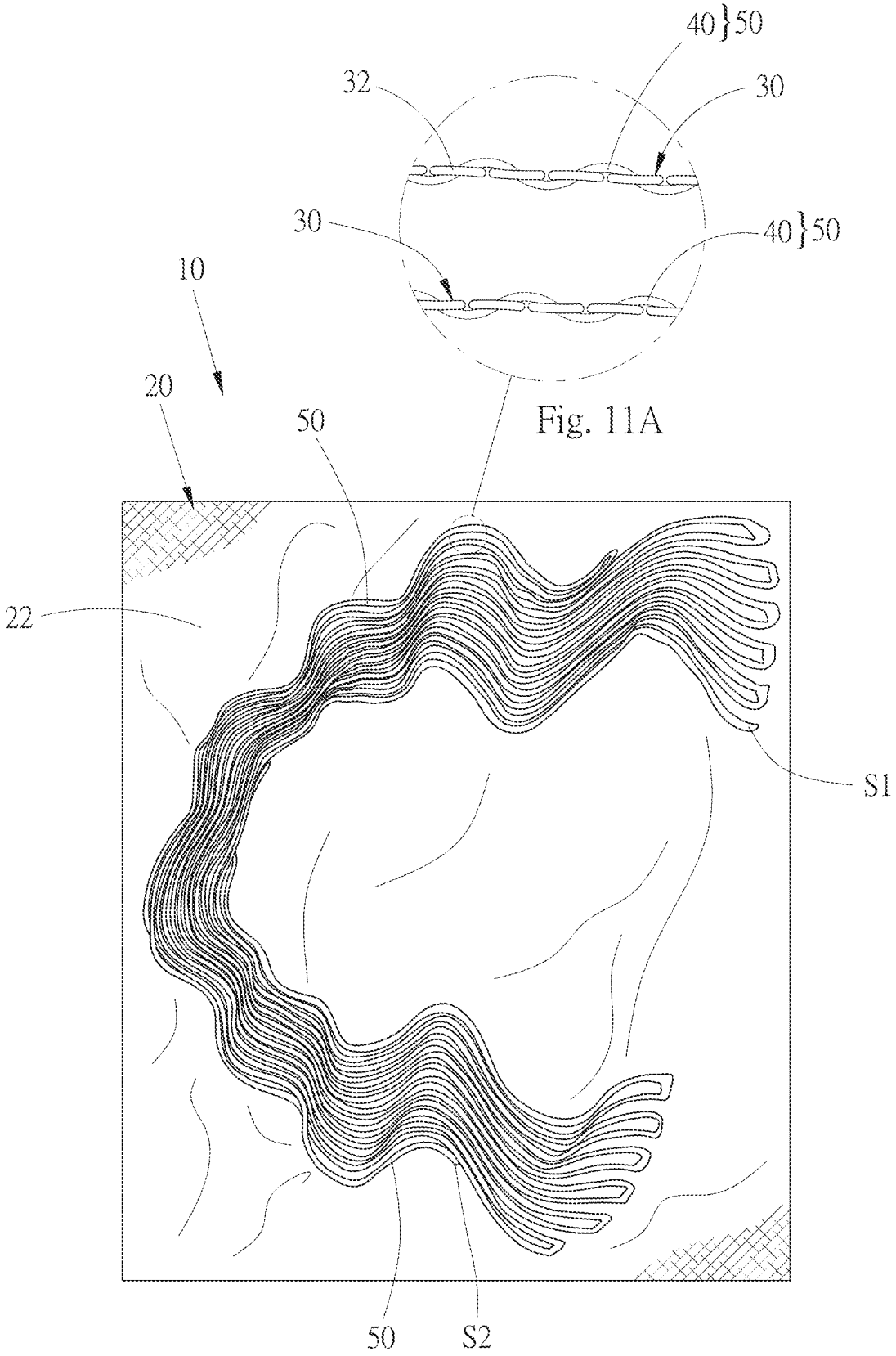
FIGS. 11 to 14 are front views of several application examples of the articles with reflective yarn according to a second preferred embodiment of the invention, showing several articles with different patterns of reflective lines.

FIG. 11 and FIG. 11A show one of the applications of a second preferred embodiment of the invention. The sheet-like object 20 of the article 10 is a fabric, a front side 22 of the object is provided with a plurality of reflective lines 50 arranged and kept apart at intervals. The reflective lines 50 in this embodiment are wavy lines and are formed by electric embroidery. From a starting point S1 to an end point S2, an upper thread 30, a lower thread (not shown) and a reflective yarn 40 are electrically embroidered on the fabric 20 to form the reflective lines 50, and the reflective yarn 40 is pressed by the upper thread 30. As shown in FIG. 11A, the reflective yarn 40 is pressed by the upper thread 30 and held on the front side 22 of the object 20 to form the reflective lines 50.

Figure 9A:
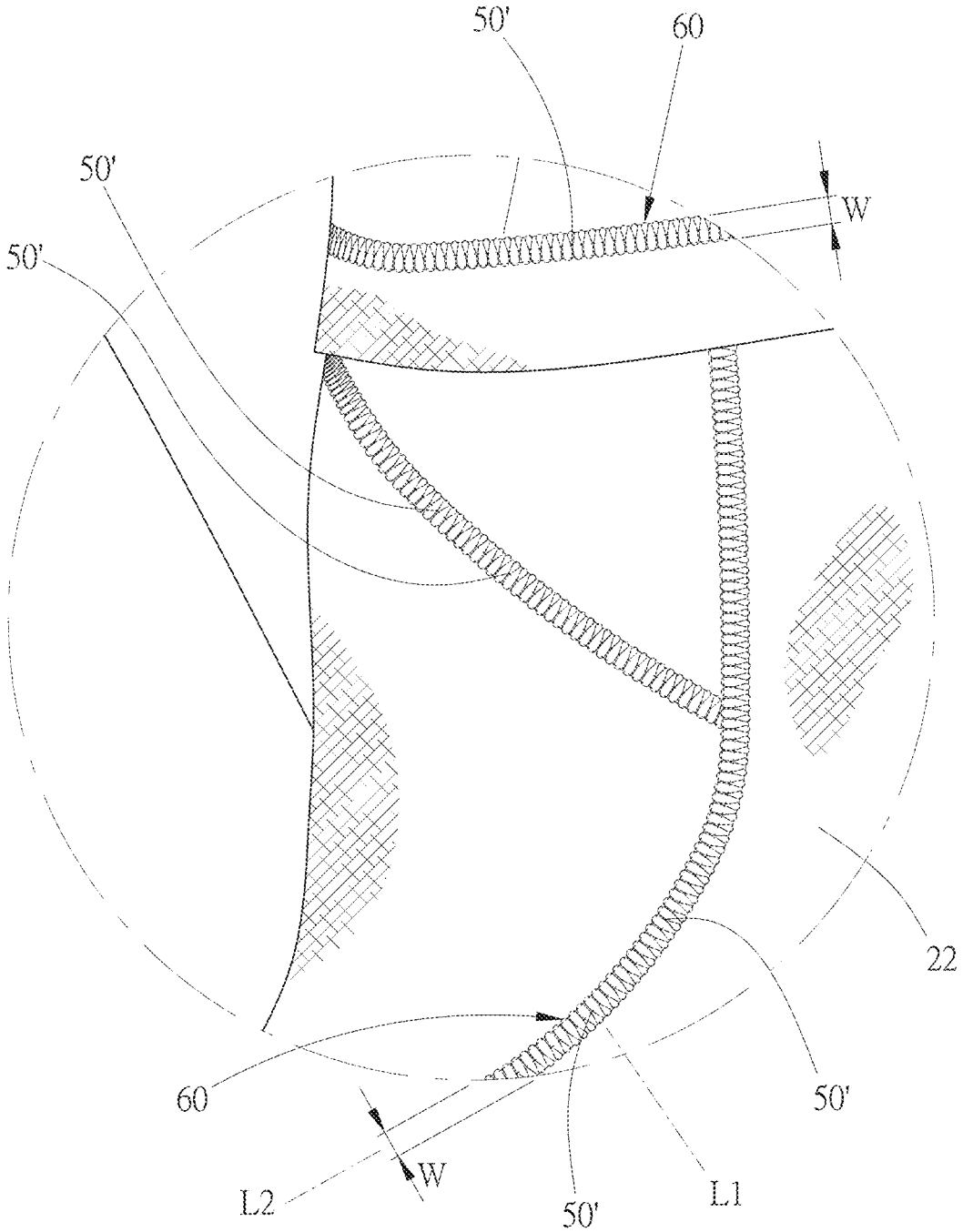
FIG. 9A is a partial enlarged view of FIG. 9.

Please refer to FIG. 9A, a plurality of reflective lines 50' are of short length and they are arranged at intervals on the front side 22 of the object, the longitudinal direction of the short reflective line is in a first direction L1. The short reflective lines 50' are arranged at intervals along a second direction L2 and form a reflective line strip 60. A length of a short reflective line 50' in the first direction L1 is the width W of the reflective line strip 60. The reflective strip 60 provides a good reflective effect. The second direction L2 can be straight, curved, or zigzag etc.

The reflective lines 50 (50') and the reflective line strips 60 in FIGS. 9, 9A and 10 can be made by the sewing method in FIG. 2, or by the electric embroidery method in FIG. 11.

Figure 12:
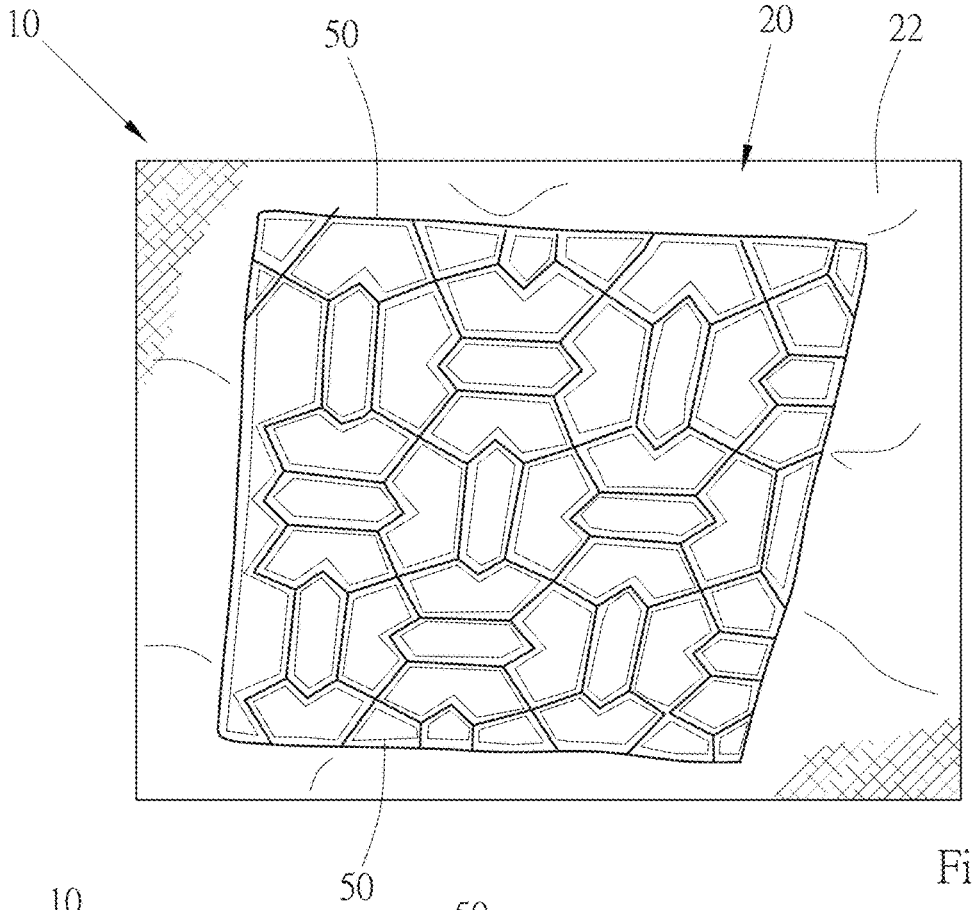
Figure 13:
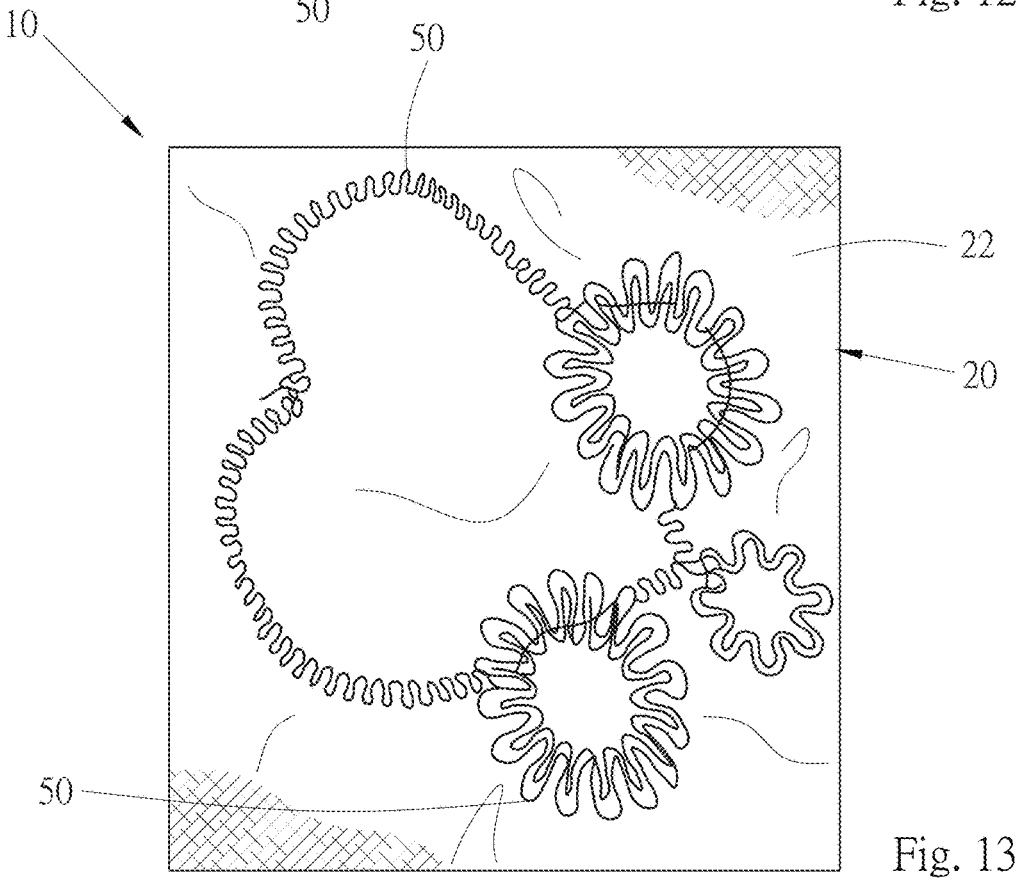
Figure 14:
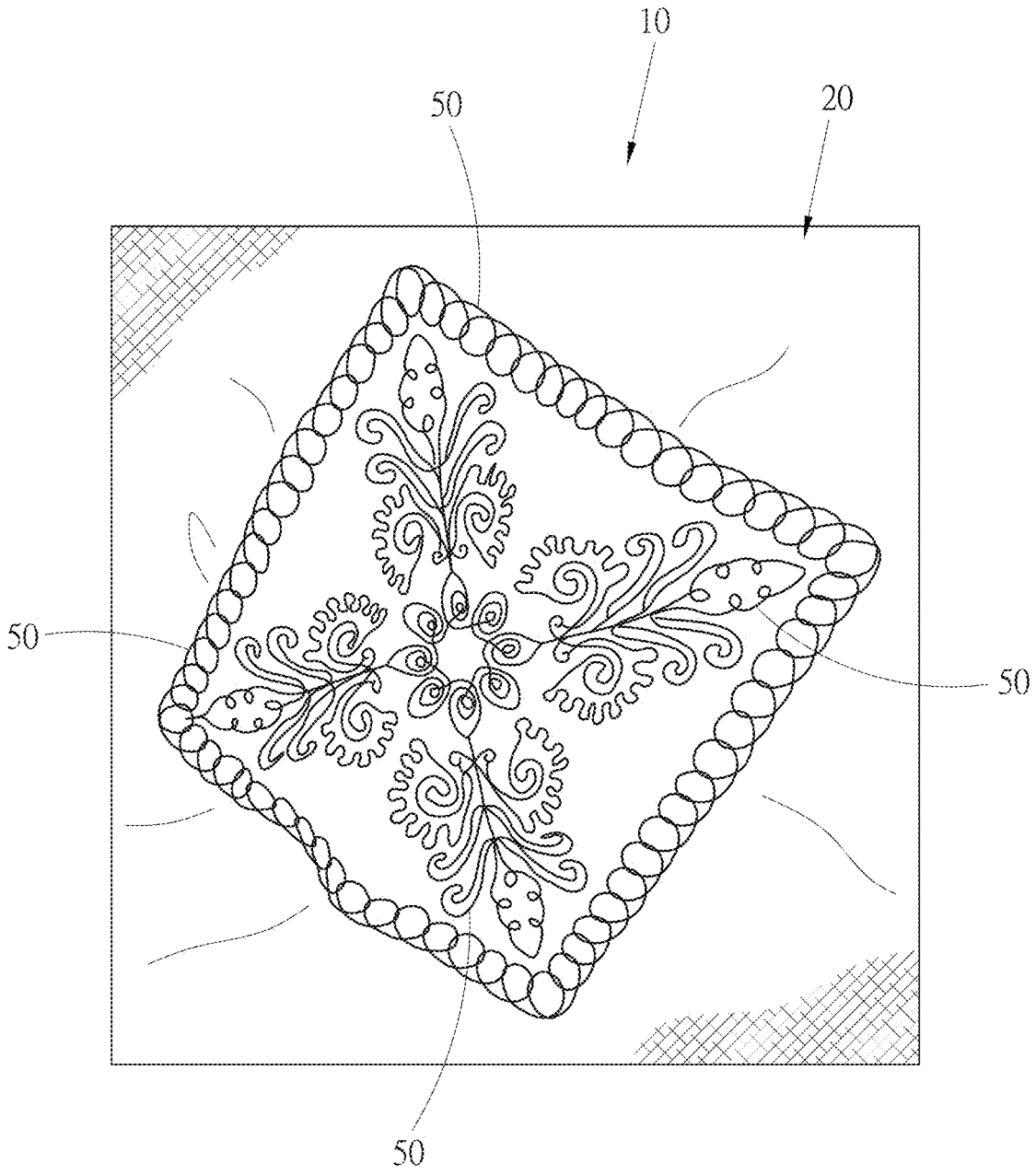

FIGS. 12 to 14 show several applications of the second preferred embodiment of the invention, each application is to electric embroider an upper thread, a lower thread and a reflective yarn on a cloth 20 from a starting point to an end point 20, make the front side 22 of the cloth 20 have a plurality of reflective lines 50. The reflective lines 50 in FIGS. 12 to 14 form different patterns. The direction of electric embroidery can be curved, wavy, polygonal, zigzag or straight to form straight, arc, polygonal, zigzag or wavy reflective lines 50. FIG. 8 and FIG. 11 show wavy or arc/curved reflective lines, and FIG. 8 also shows zigzag reflective lines. FIG. 12 shows polygonal reflective lines. FIGS. 13 and 14 show arc/curved reflective lines. Each reflective lines 50 are formed by one reflective yarn 40 being pressed on the front side 22 of the cloth by one upper thread 30.

FIGS. 9 to 14 are photographs taken when irradiating light on the article, and the reflective lines 50 of the article 10 in these figures reflect the light.

In the preferred embodiments shown in FIG. 2 and FIG. 11, the reflective yarn 40 is threaded/passed through under the adjacent seam sections 32 sequentially and regularly, and is pressed by each of the seam sections 32.

Figure 15:
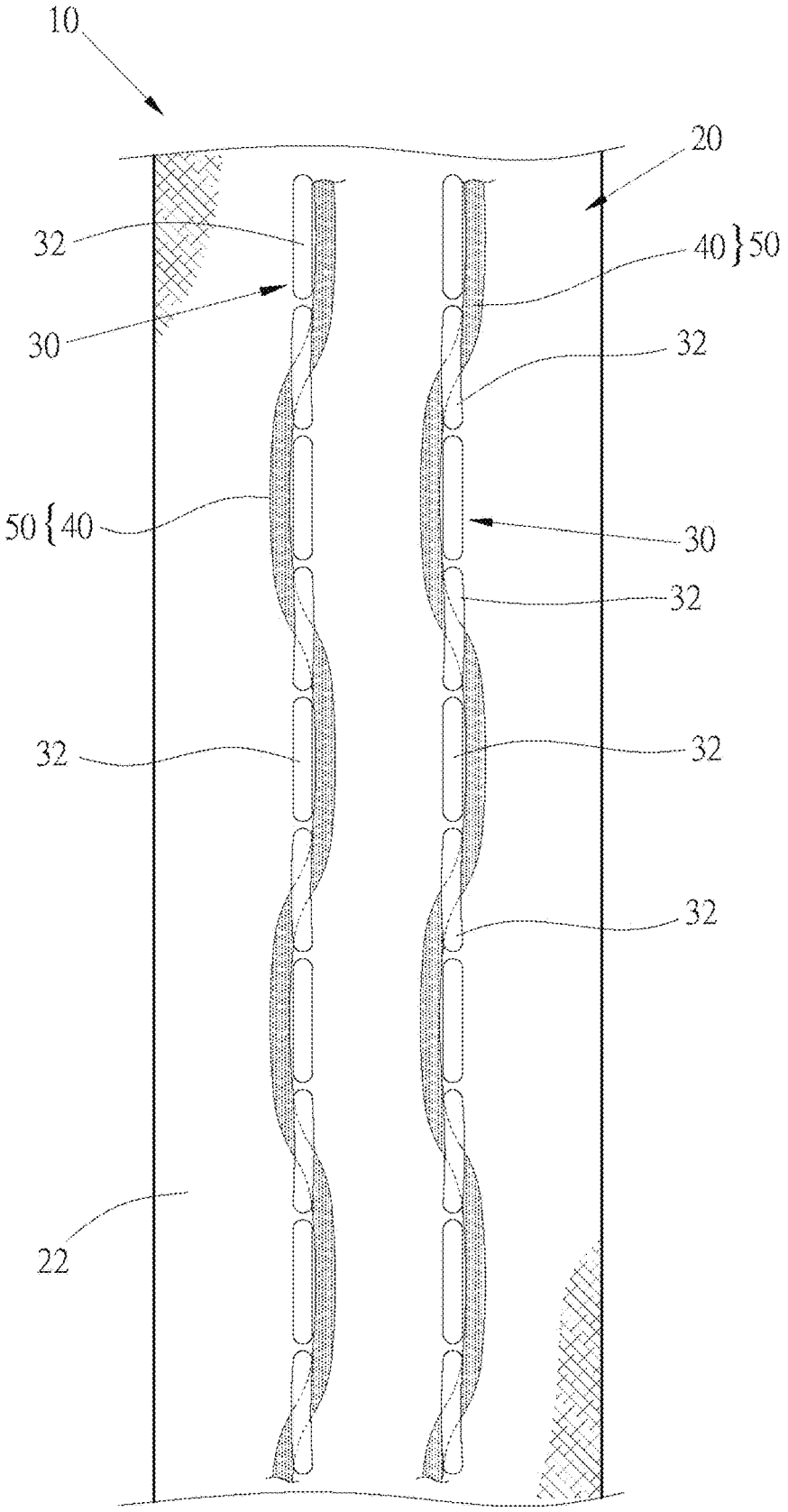
FIG. 15 shows a front view of an article with reflective yarn according to a third preferred embodiment of the invention.

FIG. 15 shows an article 10 provided by a third preferred embodiment of the invention, which includes: a sheet object 20, a plurality of upper threads 30, one or more than one lower threads (not shown in the figure), and a plurality of reflective yarns 40.

In this embodiment, the reflective yarn 40 does not pass under all the seam sections 32 of an upper thread 30, but regularly passes under the separated seam sections 32 and is pressed by the separated seam sections 32 on the front side 22 of the object 20. As shown in FIG. 15, the seam sections 32 that press the reflective yarn 40 are spaced apart, not adjacent to each other.

FIGS. 16 to 20 show several embodiments of the invention to arrange reflective lines 50 on the article 10 by using different sewing machines, such as thread babylock/thread overlock, thread coverstitch/thread coverstitch with binding, or flatlock. Thread babylock, thread overlock can be divided into models with one needle (one sewing needle) and three threads (three sewing threads), two needles and four threads; thread coverstitch, thread coverstitch with binding has models with two needles and three threads, two needles and four threads, three needles and five threads; and flatlock is a sewing machine with four needles and six threads. In order to sew the reflective yarn 40 of the invention, various sewing machines described below are equipped with a laying mechanism for laying the reflective yarn 40.

Figure 16B:
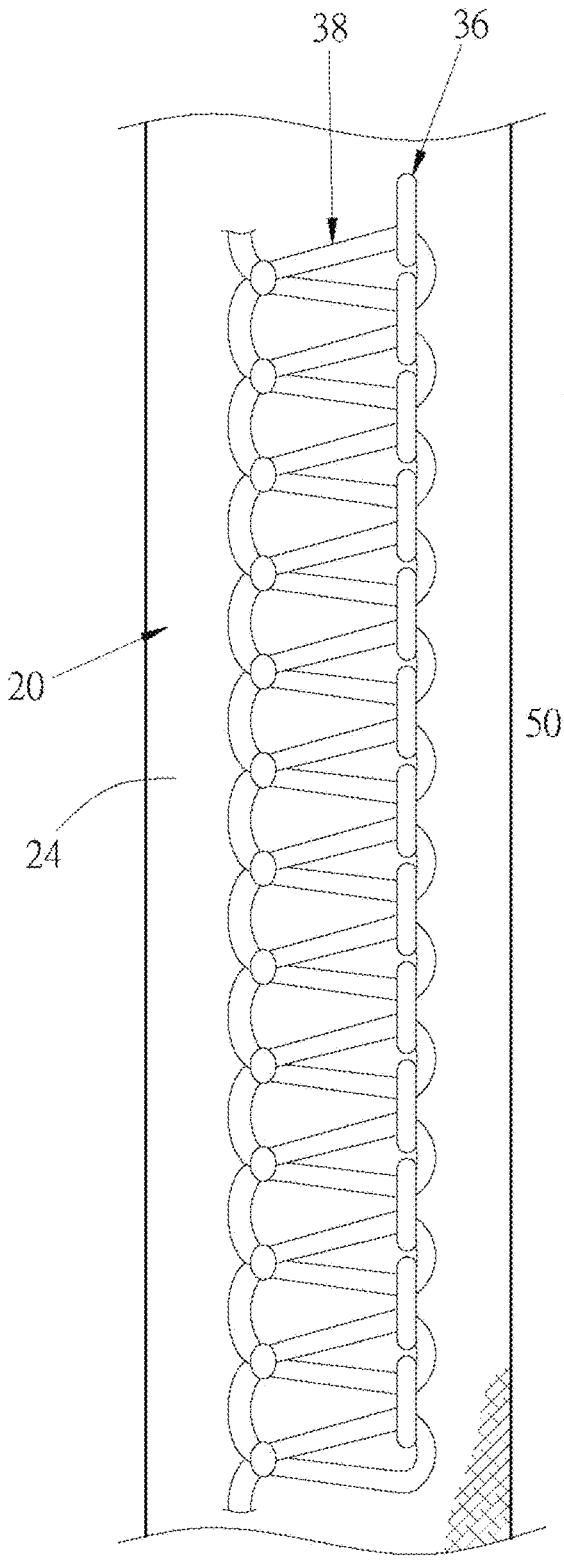
FIGS. 16A and 16B are respectively a front view and a back view of an article according to a fourth preferred embodiment of the invention.
Figure 16A:
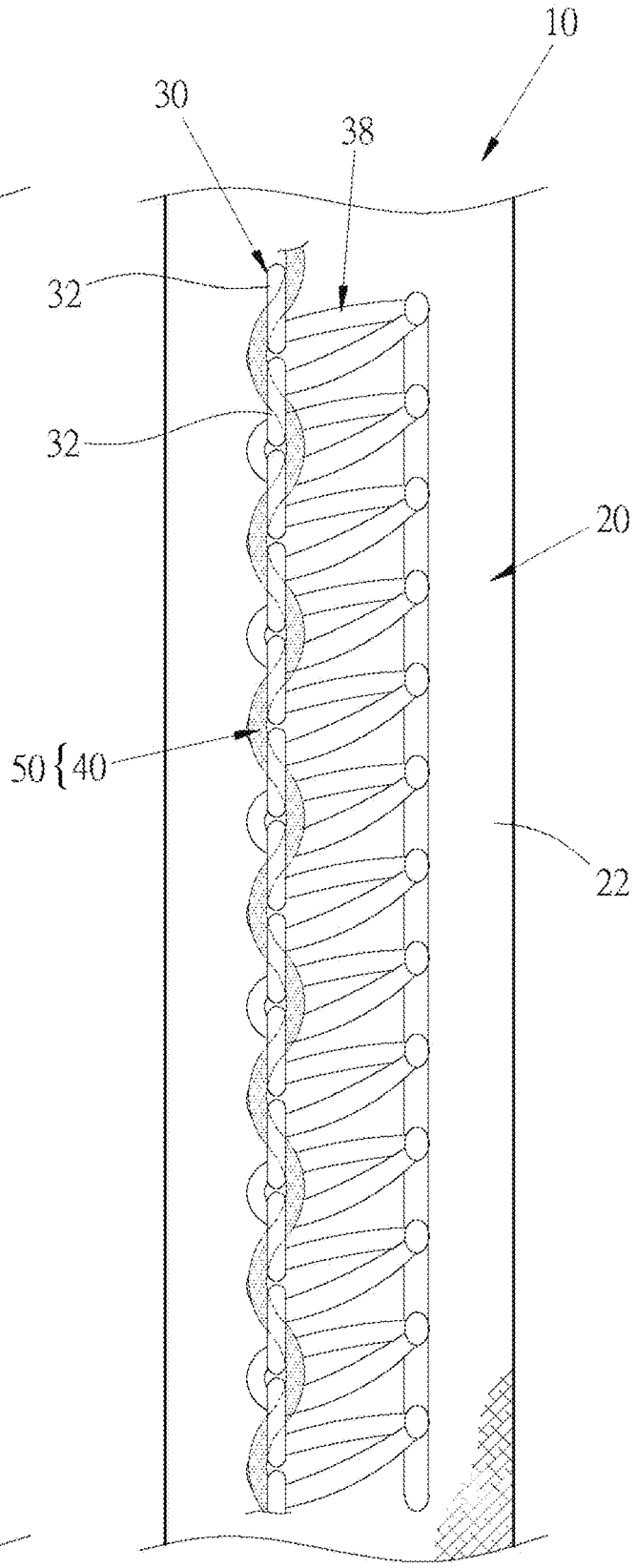

FIGS. 16A and 16B are a front view (FIG. 16A) and a back view (FIG. 16B) showing that reflective lines 50 are arranged on an article 10 by a one-needle three-thread thread babylock/thread overlock according to the invention, which comprises three sewing threads and a reflective yarn 40. One of the three sewing threads is an upper thread 30 sewed on the front side 22 of the object 20, and has seam sections 32 arranged linearly along a sewing direction; the other two sewing threads are the lower thread 36 and a cross thread 38 respectively. The cross thread 38 is defined as a lower thread. The reflective yarn 40 is arranged on the front side 22 of the object 20, and is pressed by the seam sections 32 of the upper thread 30 and held on the front side 22 of the object 20. A connection structure between the three sewing threads 30, 36, 38 is not a subject matter of the invention, and thus will not be described herein.

Figure 17B:
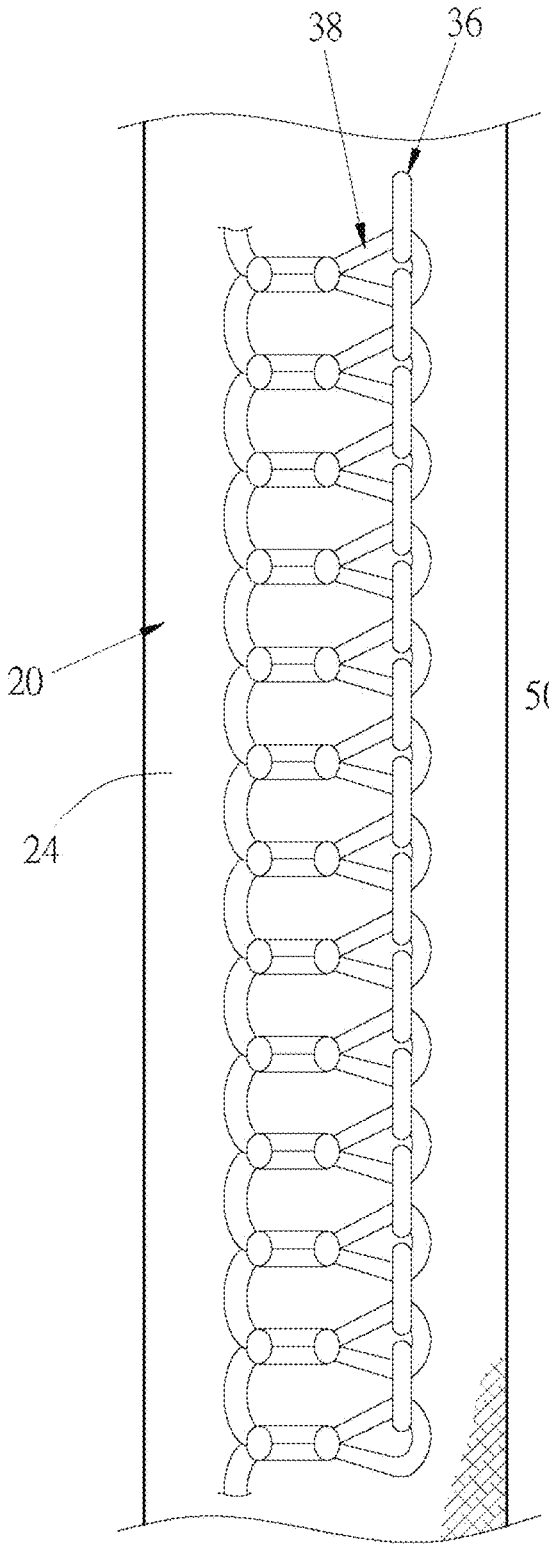
FIGS. 17A and 17B are respectively a front view and a back view of the thread body sewing structure according to a fifth preferred embodiment of the invention.
Figure 17A:
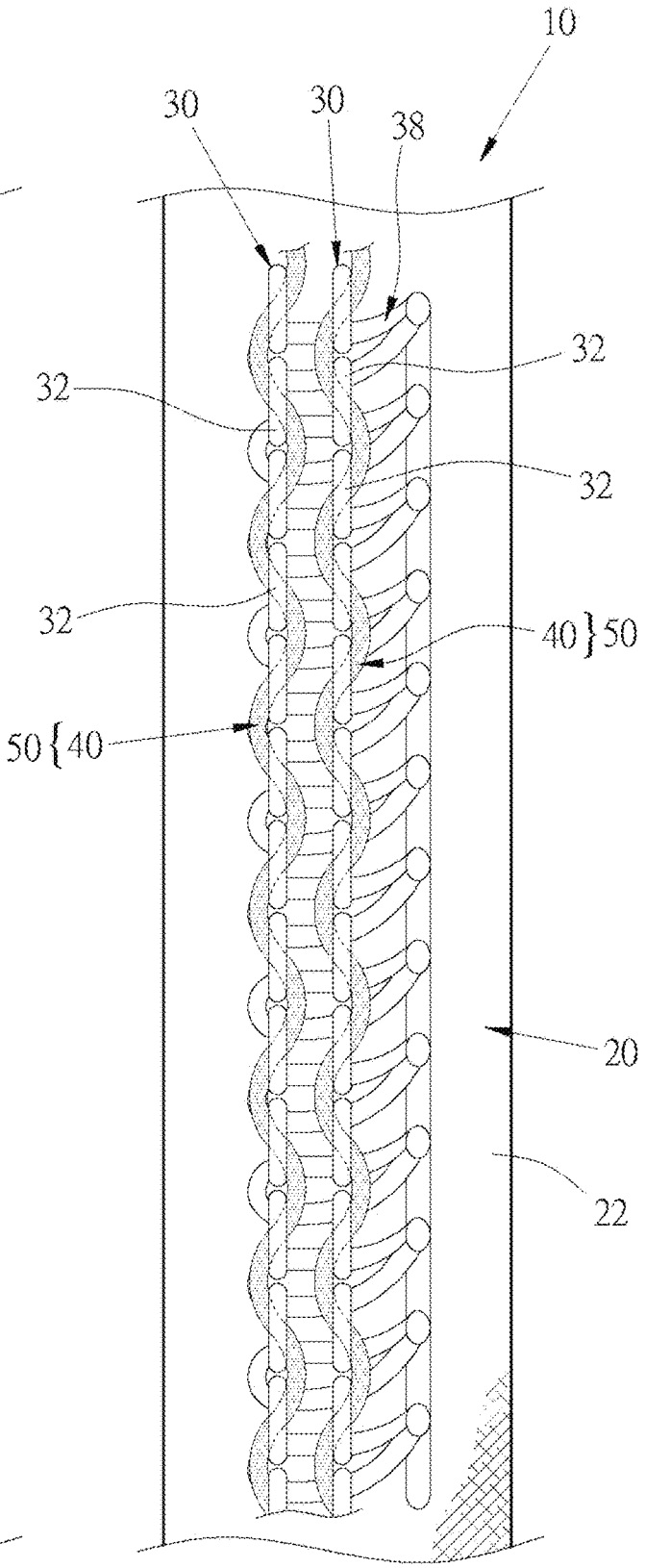

FIGS. 17A and 17B are a front view and a back view showing that reflective lines 50 are arranged on an article 10 by a two-needle four-thread thread babylock/thread overlock according to the invention, which comprises four sewing threads and two reflective yarns 40. Two of the four sewing threads are upper threads 30 of the front side 22 of the object 20, and each of the upper threads 30 has seam sections 32 extending linearly. The other two sewing threads are a lower thread 36 and across thread 38 respectively. The two reflective yarns 40 are respectively pressed by the seam sections 32 of the two upper threads 30 and held on the front side 22 of the object 20. Likewise, a connection structure between the upper threads 30, the lower thread 36 and the cross thread 38 is not a subject matter of the invention.

Figure 18B:
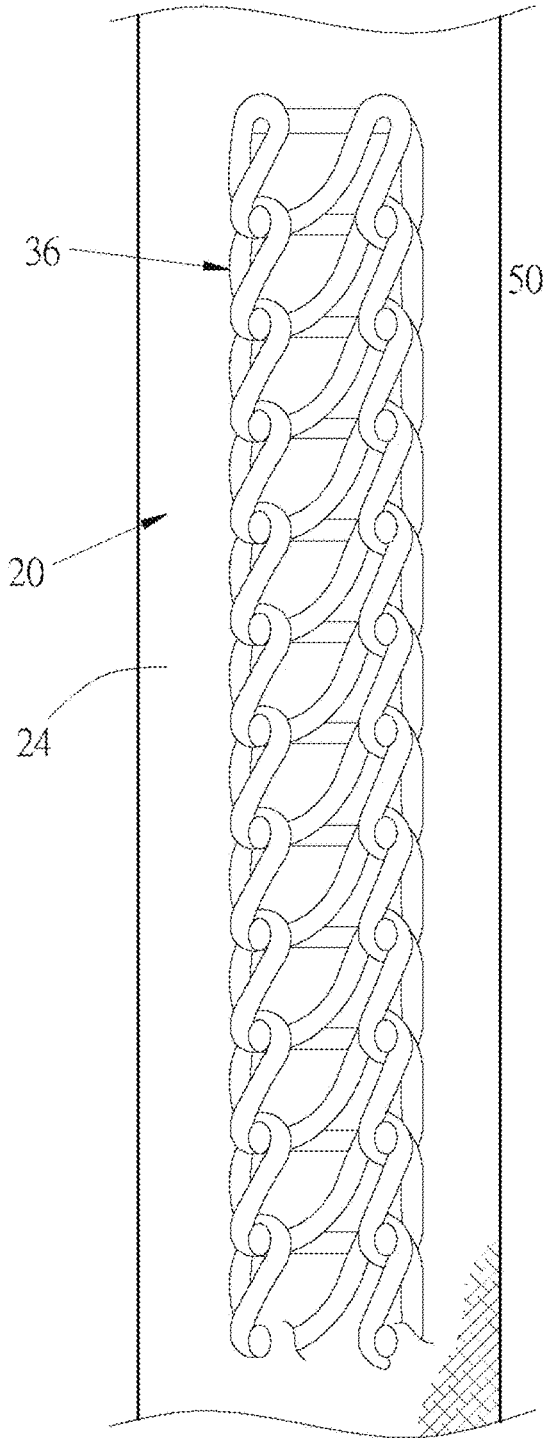
FIGS. 18A and 18B are respectively a front view and a back view of an article according to a sixth preferred embodiment of the invention.
Figure 18A:
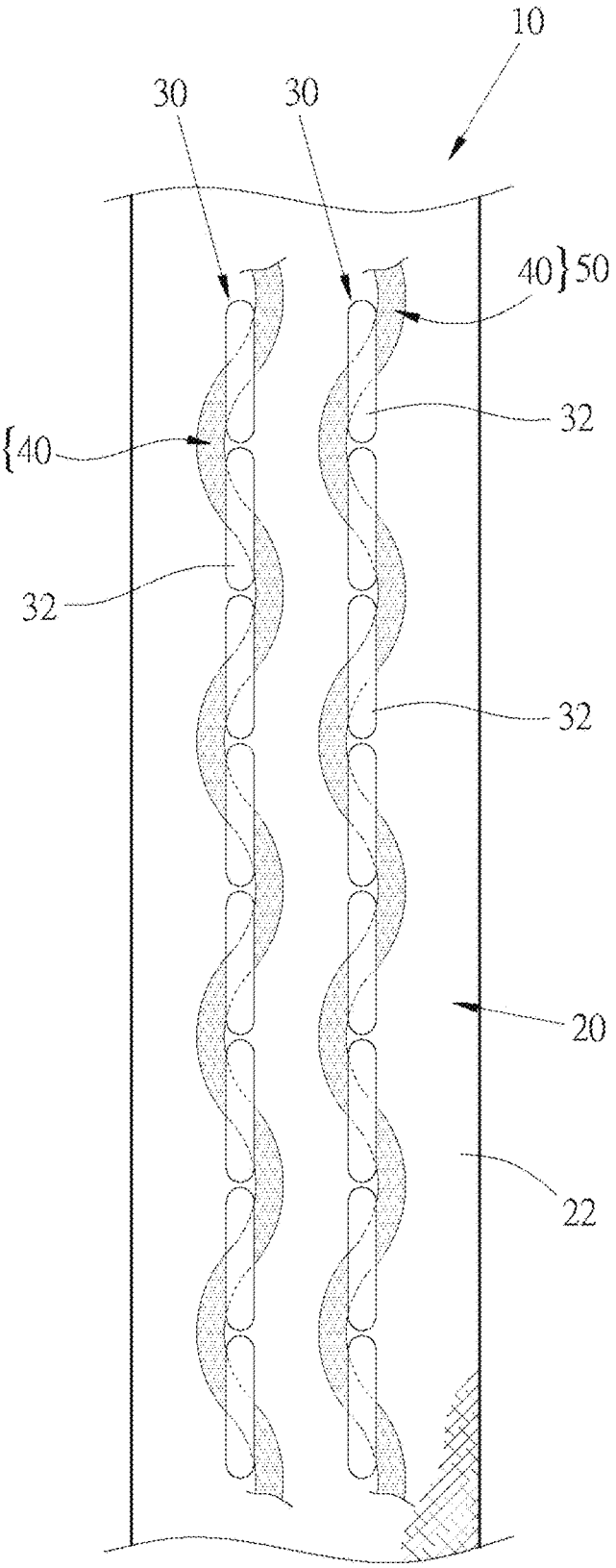

FIGS. 18A and 18B are a front side and a back side showing that reflective lines 50 are arranged on an article 10 by a two-needle three-thread thread coverstitch/thread coverstitch with binding according to the invention, which comprises three sewing threads and two reflective yarns 40, two of the sewing threads are upper threads 30 located on the front side 22 of the object 20 and have seam sections 32 extending linearly. The other sewing thread is a lower thread 36. The two reflective yarns 40 are respectively pressed by the seam sections 32 of the two upper threads 30 and held on the front side 22 of the object 20.

Figure 19B:
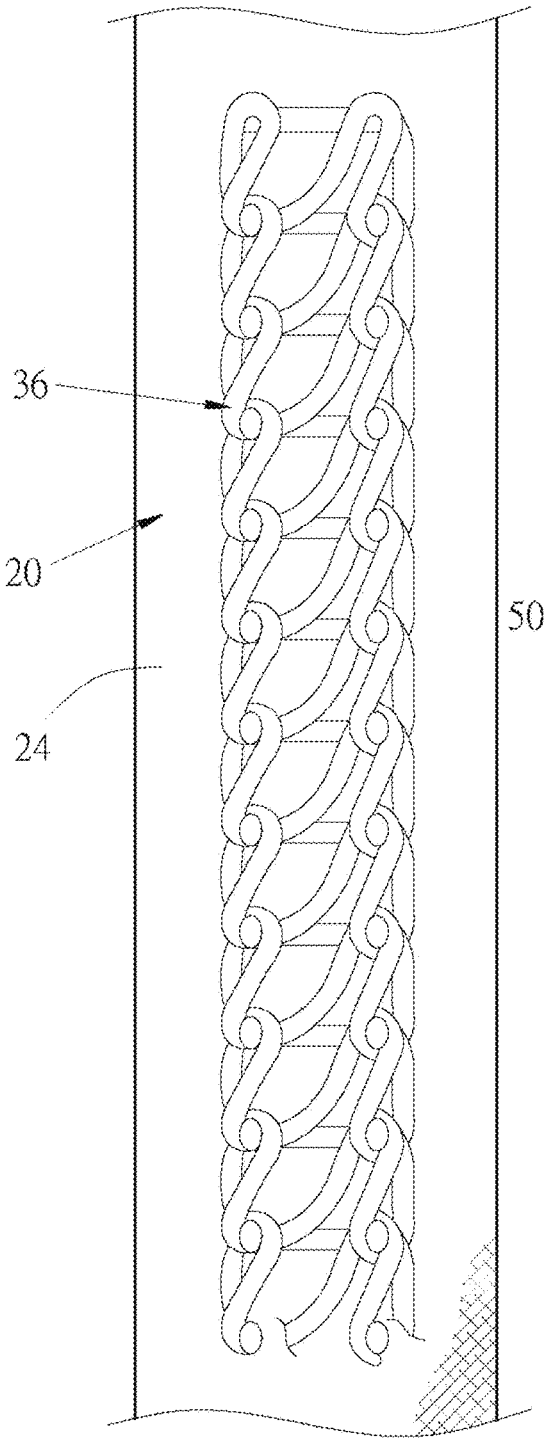
FIGS. 19A and 19B are respectively a front view and a back view of an article according to a seventh preferred embodiment of the invention.
Figure 19A:
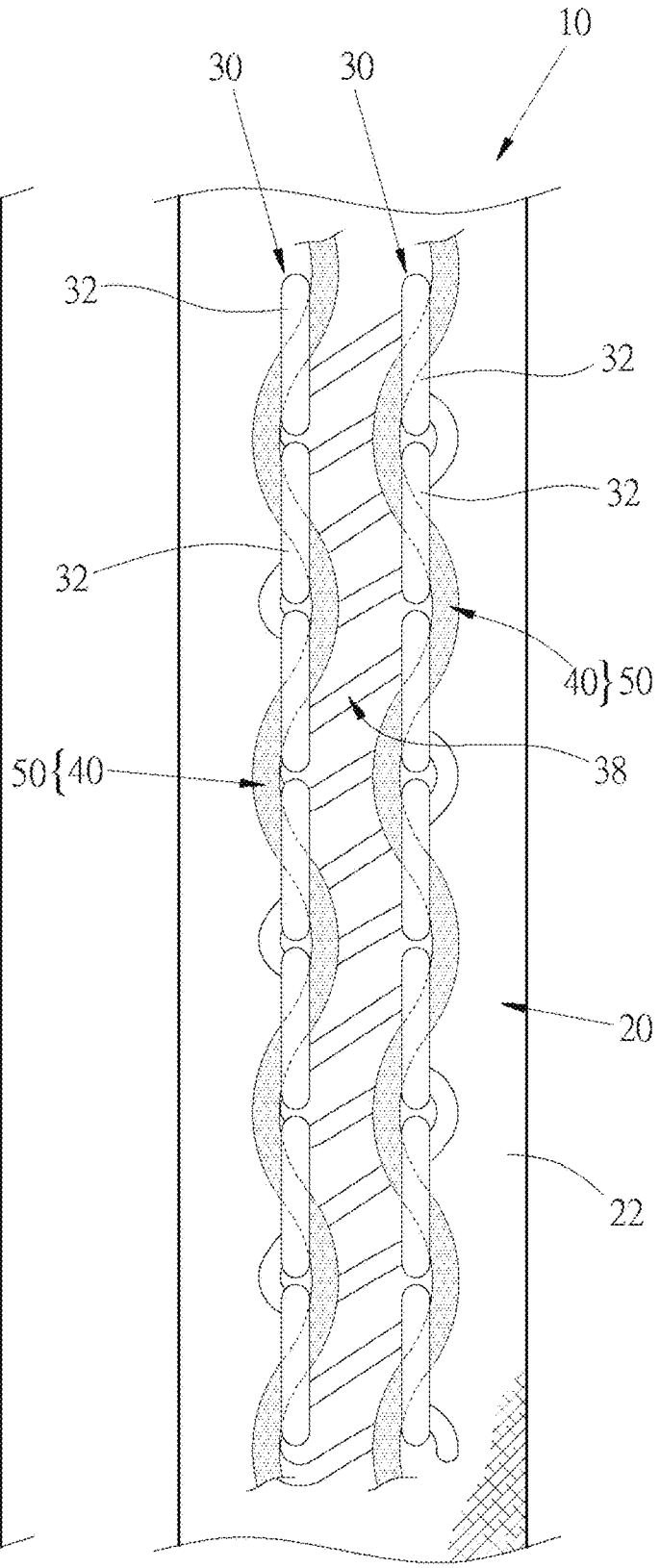

FIGS. 19A and 19B are a front side and a back side showing that reflective lines 50 are arranged on an article 10 by a two-needle four-thread thread coverstitch/thread coverstitch with binding according to the invention, which comprises four sewing threads and two reflective yarns 40, two of the sewing threads are upper threads 30 and each of the upper threads 30 has seam sections 32 extending linearly. The other two sewing threads are a lower thread 36 and a cross thread 38 respectively. The two reflective yarns 40 are respectively pressed by the seam sections 32 of the two upper threads 30 and held on the front side 22 of the object 20.

Figure 20B:
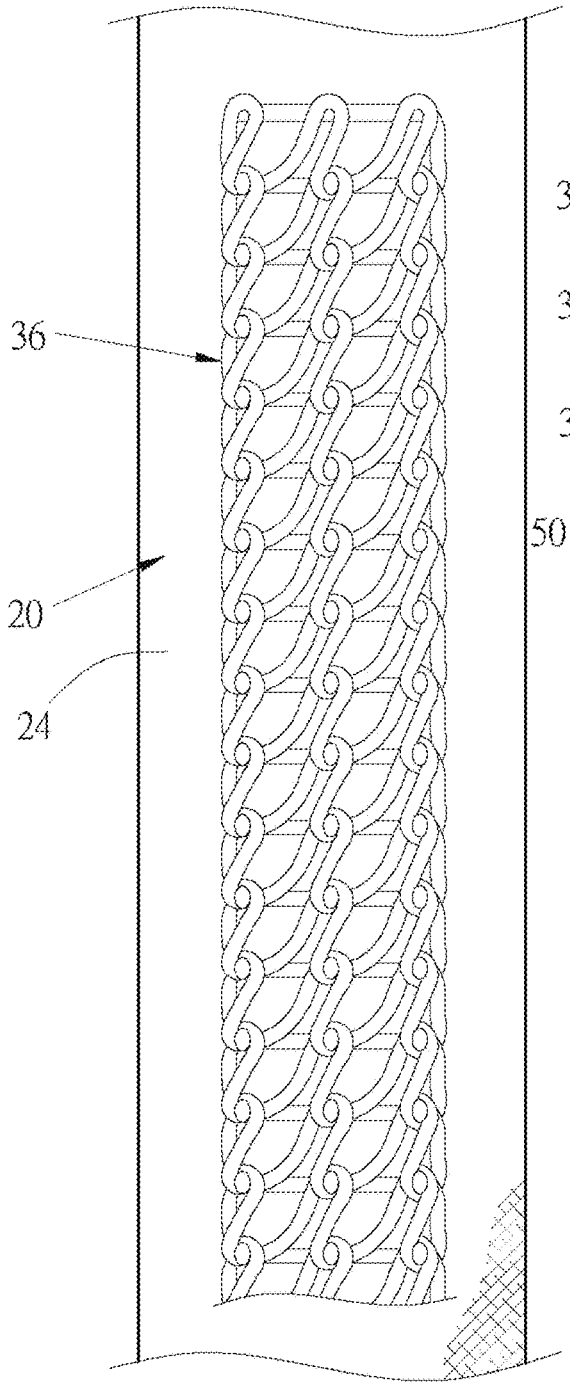
FIGS. 20A and 20B are respectively a front view and a back view of an article according to an eighth preferred embodiment of the invention.
Figure 20A:
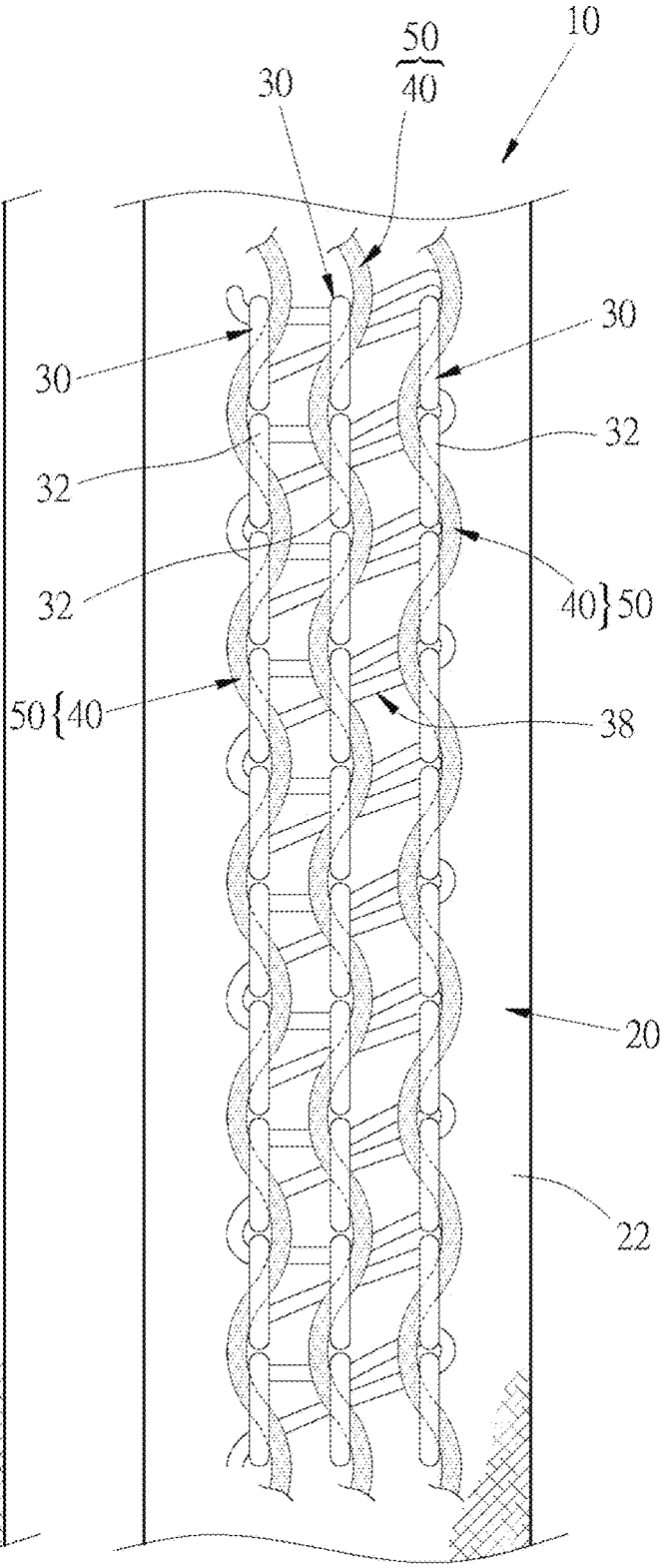

FIGS. 20A and 20B are a front side and a back side showing that reflective lines 50 are arranged on an article 10 by a three-needle five-thread thread coverstitch/thread coverstitch with binding according to the invention, which comprises five sewing threads and three reflective yarns 40, three of the sewing threads are upper threads 30 sewn on the front side 22 of the object 20 and have seam sections 32. The other two sewing threads are a lower thread 36 and a cross thread 38 respectively. The three reflective yarns 40 are respectively pressed by the seam sections 32 of the three upper threads 30 and held on the front side 22 of the object 20.

A four-needle six-thread flatlock has four upper threads 30 disposed on the front side 22 of the object 20; and one reflective yarn 40 or four reflective yarns 40 can be held by the seam sections 32 of the upper threads 30.

FIGS. 16A to 20A illustrate that one or multiple reflective yarns 40 are held by the seam sections 32 of one or multiple upper threads 30. In implementation, one reflective yarn 40 can be held by one of upper threads 30.

Through the invention, the reflective yarn 40 is held on the front side 22 of the object 20 by the upper thread 30 to form a plurality of reflective lines 50, so that the object has a reflective function and increases the safety of night activities. The reflective yarn 40 does not pass through the article, the glass beads 42 of the reflective yarn will not fall off, the glass beads on a surface of the reflective yarn can be maintained intact without detracting from a reflective function of the reflective yarn, thereby clothes sewn with the reflective yarn will not have defective products, and a manufacturing yield can be improved.

When the invention is used, the reflective yarn can be sewn on the object, because the reflective yarn does not need to pass through the object (fabric), the bare reflective yarn can be directly used, and the reflective yarn does not need to be twisted with other yarns or threads into a yarn with multiple strands. Compared with the prior art, the invention enables the bare reflective yarn to be used directly, in addition to be capable of reducing manufacturing costs and time of the reflective yarn, a thread diameter of the reflective yarn will not be increased owe to directly using the bare reflective yarn.

The reflective yarn 40 of the invention is flat on the surface of the fabric, and does not pass through the fabric, so the reflective yarn 40 will not form any bends on the surface of the fabric, it is comfortable to touch and will not produce a stinging sensation.

The reflective lines 50 of the invention are spaced apart, arranged at intervals, not closely arranged, and have a lightweight design, which can reduce the weight of clothes and material costs and manufacturing costs, and does not affect the reflective function.

The reflective yarn 40 of the invention is directly exposed on the surface of the fabric and does not penetrate into the fabric. No part of the reflective yarn is inside the fabric, effectively reducing the amount of reflective yarn used, reducing the weight of the fabric and reducing costs. Compared with the way that the reflective yarn penetrates into the fabric, the amount of the reflective yarn used in the invention is only half of the amount.

The above-mentioned embodiments are merely used to illustrate the technical ideas and features of the invention, with an object to enable any person having ordinary skill in the art to understand the technical content of the invention and implement it accordingly, the embodiments are not intended to limit the claims of the invention, and all other equivalent changes and modifications completed based on the technical means disclosed in the invention should be included in the claims covered by the invention.

What is claimed is:

1. An article provided with reflective yarn comprising:

a sheet-shaped object with a front side and a bottom side located on a side opposite to the front side;

one or more than one upper threads sewn on the sheet-shaped object along a sewing direction and located on the front side of the sheet-shaped object;

at least one lower thread disposed on the bottom side of the object, the at least one lower thread and said one or more than one upper threads being connected with each other;

one or more than one reflective yarns with glass beads, said one or more than one reflective yarns being disposed on the front side of the sheet-shaped object without penetrating or passing through the object, said one or more than one reflective yarns being pressed and held on the front side of the object by said one or more than one upper threads; and on the front side of the sheet-shaped object, said one or more than one reflective yarns form a plurality of reflective lines, and said reflective lines being kept apart with intervals.

2. The article as claimed in claim 1, wherein said one or more than one upper threads form a plurality of seam sections on the front side of the sheet-shaped object along the sewing direction of said one or more than one upper threads, and said one or more than one reflective yarns are pressed by the seam sections of said one or more than one upper threads.

3. The article as claimed in claim 1, wherein each of said reflective yarns is held by each of said upper threads, and each of said reflective yarns passes each of said upper threads from two sides of the upper thread alternately.

4. The article as claimed in claim 2, wherein each of said reflective yarns is held by each of said upper threads, and each of said reflective yarns passes the seam sections of each of said upper threads in sequence.

5. The article as claimed in claim 2, wherein each of the said reflective yarns is held by each of said upper threads, and each of said reflective yarns passes the non-adjacent seam sections of each of said upper threads and is held by the non-adjacent seam sections.

6. The article as claimed in claim 1, wherein every two adjacent reflective lines of said reflective lines are lines spaced with an interval.

7. The article as claimed in claim 6, wherein said reflective lines are straight lines, arc lines, polygonal lines, zigzag lines or wavy lines.

8. The article as claimed in claim 1, wherein said reflective lines are straight lines, arc lines polygonal lines, zigzag lines or wavy lines with intervals.

9. The article as claimed in claim 1, wherein a plurality of said reflective lines are of short length, and the short reflective lines are arranged at intervals along a direction to form a reflective line strip.

10. The article as claimed in claim 9, wherein the longitudinal direction of the short reflective lines is in a first direction, and the length of the short reflective lines in the first direction is the width of the reflective line strip.

11. The article as claimed in claim 1, wherein said reflective lines form at least one patterns on the front side of the sheet-shaped object.

12. The article as claimed in claim 1, wherein the article is a clothing or a bag, made of the sheet-like object; said reflective lines are located on an outer surface of the clothing or the bag.

* * * * *